US010301897B2

(12) United States Patent
Arteaga et al.

(10) Patent No.: US 10,301,897 B2
(45) Date of Patent: May 28, 2019

(54) BLOWOUT PREVENTER SYSTEMS AND METHODS

(71) Applicant: CAMERON INTERNATIONAL CORPORATION, Houston, TX (US)

(72) Inventors: Nicolas J. Arteaga, Jersey Village, TX (US); David Rossi, Katy, TX (US)

(73) Assignee: Cameron International Corporation, Houston, TX (US)

( * ) Notice: Subject to any disclaimer, the term of this patent is extended or adjusted under 35 U.S.C. 154(b) by 142 days.

(21) Appl. No.: 15/259,829

(22) Filed: Sep. 8, 2016

(65) Prior Publication Data

US 2018/0066492 A1 Mar. 8, 2018

(51) Int. Cl.
*E21B 33/06* (2006.01)
*E21B 33/128* (2006.01)

(52) U.S. Cl.
CPC ..... *E21B 33/06* (2013.01); *E21B 33/128* (2013.01); *Y10T 137/5983* (2015.04)

(58) Field of Classification Search
CPC ..... E21B 33/06; E21B 33/064; E21B 33/085; E21B 33/12; E21B 33/128; E21B 33/08; B29L 2031/265; Y10T 137/5983; Y10T 29/49297
USPC ..... 251/1.1, 1.2; 277/327, 329, 341, 340, 277/339; 166/84.4, 86.2, 85.4, 84.3
See application file for complete search history.

(56) References Cited

U.S. PATENT DOCUMENTS 3,917,293 A * 11/1975 Lewis ..... E21B 33/06 251/1.2
3,958,808 A * 5/1976 Lewis ..... E21B 33/06 251/1.2
4,098,516 A * 7/1978 Murman ..... E21B 33/06 251/1.2
4,605,195 A * 8/1986 Burton ..... E21B 33/06 251/1.2
4,657,263 A * 4/1987 Hynes ..... E21B 33/06 251/1.3
5,361,832 A * 11/1994 Van Winkle ..... E21B 33/06 166/84.4

* cited by examiner

*Primary Examiner* — Craig J Price
*Assistant Examiner* — Andrew J Rost
(74) *Attorney, Agent, or Firm* — Helene Raybaud

(57) ABSTRACT

An annular elastomeric packer for a blowout preventer includes a first insert including an upper flange extending between a radially inner end and a radially outer end, a lower flange extending between a radially inner end and a radially outer end, and a rib extending between the upper flange and the lower flange, wherein the rib includes a length extending between an upper end and a lower end of the rib, a second insert including an upper flange extending between a radially inner end and a radially outer end, a lower flange extending between a radially inner end and a radially outer end, and a rib extending between the upper flange and lower flange, wherein the rib includes a length extending between an upper end and a lower end of the rib, an elastomeric body coupled to the first insert and the second insert, and including an inner sealing surface.

18 Claims, 21 Drawing Sheets

BLOWOUT PREVENTER SYSTEMS AND METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling systems utilize drilling fluid or mud for drilling a wellbore in a subterranean earthen formation. In some applications, a blowout preventer (BOP) is installed at a wellhead that extends from the surface, where the BOP is configured to control the inlet and outlet of fluid from the wellbore, and particularly, to confine well fluid in the wellbore in response to a "kick" or rapid influx of formation fluid into the wellbore. An individual BOP stack may include both ram BOPs and annular BOPs. Ram BOPs include one or more rams that extend towards the center of the wellbore upon actuation to restrict flow through the ram BOP. In some applications, the inner sealing surface of each ram of the ram BOP is fitted with an elastomeric packer for sealing the wellbore. Annular BOPs are configured to close or seal against the outer surface of a drill string extending through the BOP stack and into the wellbore. Annular BOPs generally include an annular elastomeric packer engaged by a piston, where upon actuation the annular packer seals the bore of the annular BOP. In some applications, the sealing integrity provided by the packer may be reduced in response to the flow or extrusion of the elastomeric material forming the packer in response to actuation of the annular BOP into a closed position.

SUMMARY

An embodiment of an annular elastomeric packer for a blowout preventer comprises a first insert comprising an upper flange extending between a radially inner end and a radially outer end, a lower flange extending between a radially inner end and a radially outer end, and a rib extending between the upper flange and the lower flange, wherein the rib comprises a length extending between an upper end and a lower end of the rib, a second insert comprising an upper flange extending between a radially inner end and a radially outer end, a lower flange extending between a radially inner end and a radially outer end, and a rib extending between the upper flange and the lower flange, wherein the rib comprises a length extending between an upper end and a lower end of the rib, an elastomeric body coupled to the first insert and the second insert, and comprising an inner sealing surface, wherein the length of the rib of the first insert is greater than the length of the rib of the second insert. In some embodiments, the first insert comprises a length extending between an upper end of the upper flange and a lower end of the lower flange, the second insert comprises a length extending between an upper end of the upper flange and a lower end of the lower flange, and the length of the first insert is greater than the length of the second insert. In some embodiments, the upper flange of the first insert comprises a length extending between the radially inner end of the upper flange and the radially outer end of the upper flange, the upper flange of the second insert comprises a length extending between the radially inner end of the upper flange and the radially outer end of the upper flange, and the length of the upper flange of the first insert is greater than the length of the upper flange of the second insert. In certain embodiments, the upper flange of the first insert comprises a pair of lateral ends extending between the radially inner end and the radially outer end of the upper flange, the upper flange of the second insert comprises a pair of lateral ends extending between the radially inner end and the radially outer end of the upper flange, and an arcuate overlap extends between a lateral end of the upper flange of the first insert and a lateral end of the upper flange of the second insert. In some embodiments, a lateral end of the lower flange of the first insert is circumferentially spaced from a lateral end of the lower flange of the second insert. In some embodiments, the elastomeric packer further comprises a plurality of the first inserts, and a plurality of the second inserts, wherein the plurality of the first inserts and the plurality of the second inserts are disposed along a common circumference.

An embodiment of an annular elastomeric packer for a blowout preventer comprises a first insert comprising an upper flange extending between a radially inner end and a radially outer end, the upper flange comprising a width extending between a pair of lateral sides of the upper flange, a lower flange extending between a radially inner end and a radially outer end, and a rib extending between the upper flange and the lower flange, a second insert comprising an upper flange extending between a radially inner end and a radially outer end, the upper flange comprising a width extending between a pair of lateral sides of the upper flange, a lower flange extending between a radially inner end and a radially outer end, and a rib extending between the upper flange and the lower flange, an elastomeric body coupled to the first insert and the second insert, and comprising an inner sealing surface, wherein the length of the rib of the first insert is greater than the length of the rib of the second insert. In some embodiments, the elastomeric packer further comprises a plurality of the first inserts, and a plurality of the second inserts. In some embodiments, the plurality of the first inserts and the plurality of the second inserts are disposed along a common circumference. In certain embodiments, the upper flange of the first insert arcuately overlaps with the upper flange of the second insert. In certain embodiments, a lateral end of the lower flange of the first insert is arcuately spaced from a lateral end of the lower flange of the second insert. In some embodiments, the rib of the first insert comprises a length extending between an upper end and a lower end of the rib, the rib of the second insert comprises a length extending between an upper end and a lower end of the rib, and the length of the rib of the first insert is greater than the length of the rib of the second insert.

An embodiment of a blowout preventer comprises a housing comprising a bore extending therein, an annular piston slidably disposed in the bore of the housing, and an annular elastomeric packer disposed in the bore of the housing and in physical engagement with the piston, wherein the elastomeric packer comprises: a plurality of circumferentially spaced first inserts, an elastomeric body coupled to the plurality of inserts and comprising an inner sealing surface, wherein the blowout preventer comprises a first position providing fluid communication through the bore of the housing, and a second position restricting fluid communication through the bore of the housing, wherein, when the blowout preventer is disposed in the second position, there is an arcuate overlap between each adjacently disposed insert of the plurality of circumferentially spaced inserts. In some embodiments, the plurality of inserts comprises a plurality of first inserts and a plurality of second inserts. In some embodiments, the plurality of first inserts and the plurality of second inserts are disposed along a common circumference. In certain embodiments, each first insert comprises an upper flange extending between a radially inner end and a radially outer end, a lower flange extending between a radially inner end and a radially outer end, and a rib extending between the upper flange and the lower flange, wherein the rib comprises a length extending between an upper end and a lower end of the rib, each second insert comprises an upper flange extending between a radially inner end and a radially outer end, a lower flange extending between a radially inner end and a radially outer end, and a rib extending between the upper flange and the lower flange, wherein the rib comprises a length extending between an upper end and a lower end of the rib, the length of the rib of the first insert is greater than the length of the rib of the second insert. In certain embodiments, each first insert comprises a length extending between an upper end of the upper flange and a lower end of the lower flange, each second insert comprises a length extending between an upper end of the upper flange and a lower end of the lower flange, and the length of the first insert is greater than the length of the second insert. In certain embodiments, the upper flange of each first insert comprises a length extending between the radially inner end of the upper flange and the radially outer end of the upper flange, the upper flange of each second insert comprises a length extending between the radially inner end of the upper flange and the radially outer end of the upper flange, and the length of the upper flange of each first insert is greater than the length of the upper flange of each second insert. In some embodiments, each first insert comprises an upper flange extending between a radially inner end and a radially outer end, the upper flange comprising a width extending between a pair of lateral sides of the upper flange, a lower flange extending between a radially inner end and a radially outer end, and a rib extending between the upper flange and the lower flange, each second insert comprises an upper flange extending between a radially inner end and a radially outer end, the upper flange comprising a width extending between a pair of lateral sides of the upper flange, a lower flange extending between a radially inner end and a radially outer end, and a rib extending between the upper flange and the lower flange, the length of the rib of the first insert is greater than the length of the rib of the second insert. In some embodiments, the upper flange of each first insert comprises a pair of lateral ends extending between the radially inner end and the radially outer end of the upper flange, the upper flange of each second insert comprises a pair of lateral ends extending between the radially inner end and the radially outer end of the upper flange, and an arcuate overlap extends between a lateral end of the upper flange of each first insert and a lateral end of the upper flange of each second insert.

BRIEF DESCRIPTION OF THE DRAWINGS

For a detailed description of exemplary embodiments, reference will now be made to the accompanying drawings in which.

DETAILED DESCRIPTION

Figure 1:
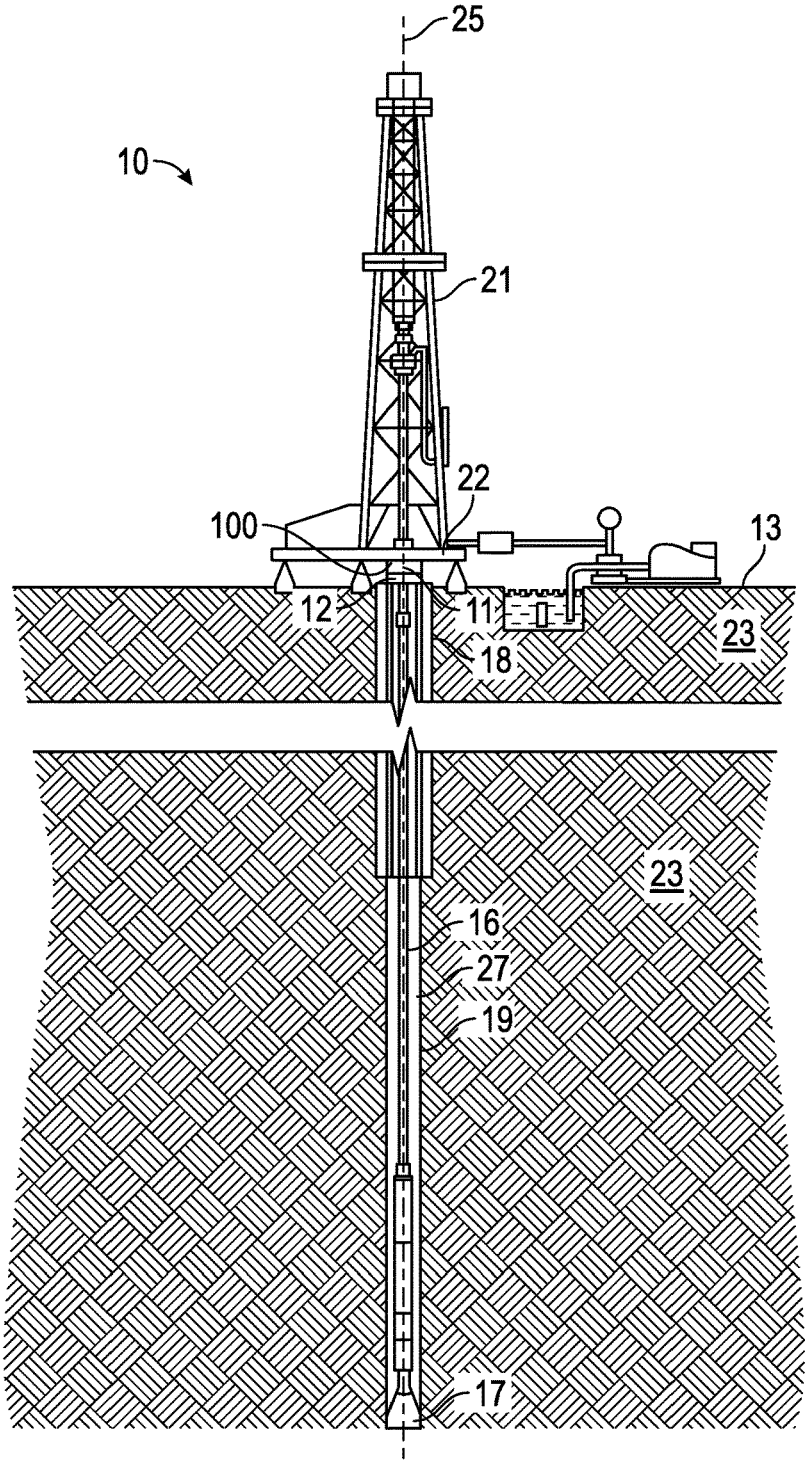
FIG. 1 is a schematic view of an embodiment of a well system including a BOP in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, an embodiment of a well or drilling system 10 for drilling and/or producing a well is shown. In this embodiment, system 10 includes a blowout preventer (BOP) stack 11 mounted to a wellhead 12 disposed at the surface 13 above a wellbore 19 extending into an earthen subterranean formation 23. In the embodiment shown in FIG. 1, BOP stack 11 includes an annular BOP 100 at an upper end thereof. A drill string 16 extends from a drilling rig or platform 20. In this embodiment, platform 20 includes a derrick or mast 21 that extends from a rig floor 22 of platform 20. A primary conductor 18 of well system 10 extends from wellhead 12 into wellbore 19. BOP stack 11 (including annular BOP 100), wellhead 12, and conductor 18 are arranged such that each shares a common central or longitudinal axis 25. In other words, BOP stack 11, wellhead 12, and conductor 18 are coaxially aligned.

During operation of well system 10, drill string 16 extends into wellbore 19 via an internal bore of BOP stack 11 and wellhead 12, where the dill string 16 includes a drill bit 17 coupled to a lower end thereof. In this operation, drilling fluid is pumped from platform 20, through drill string 16, and into wellbore 19 via ports disposed in drill bit 17. From wellbore 19, the pumped drilling fluid is recirculated to platform 20 via an annulus 27 extending between an outer surface of drill string 16 and an inner surface of wellbore 19. During operation of well system 10, it may become necessary to fluidically isolate wellbore 19 from the surrounding environment, such as in the case of an uncontrolled influx of fluid into wellbore 19 from the subterranean earthen formation 23. In such an event, BOP stack 11 (including annular BOP 100) is configured to restrict fluid communication between wellbore 19 and the surrounding environment. In certain embodiments, annular BOP 100 is actuated from a first or open position to a second or closed position sealing against drill pipe 16 in response to an uncontrolled influx of fluid into wellbore 19 from formation 23. In other instances, BOP 100 may be actuated from the open position to the closed position to seal wellbore 19 from the surrounding environment when drill string 16 is disposed within the bore of BOP 100. Although in this embodiment annular BOP 100 is shown as forming a part of BOP stack 11 of drilling system 10, in other embodiments, annular BOP 100 may be used in other well or drilling systems, including offshore well systems.

Figure 2:
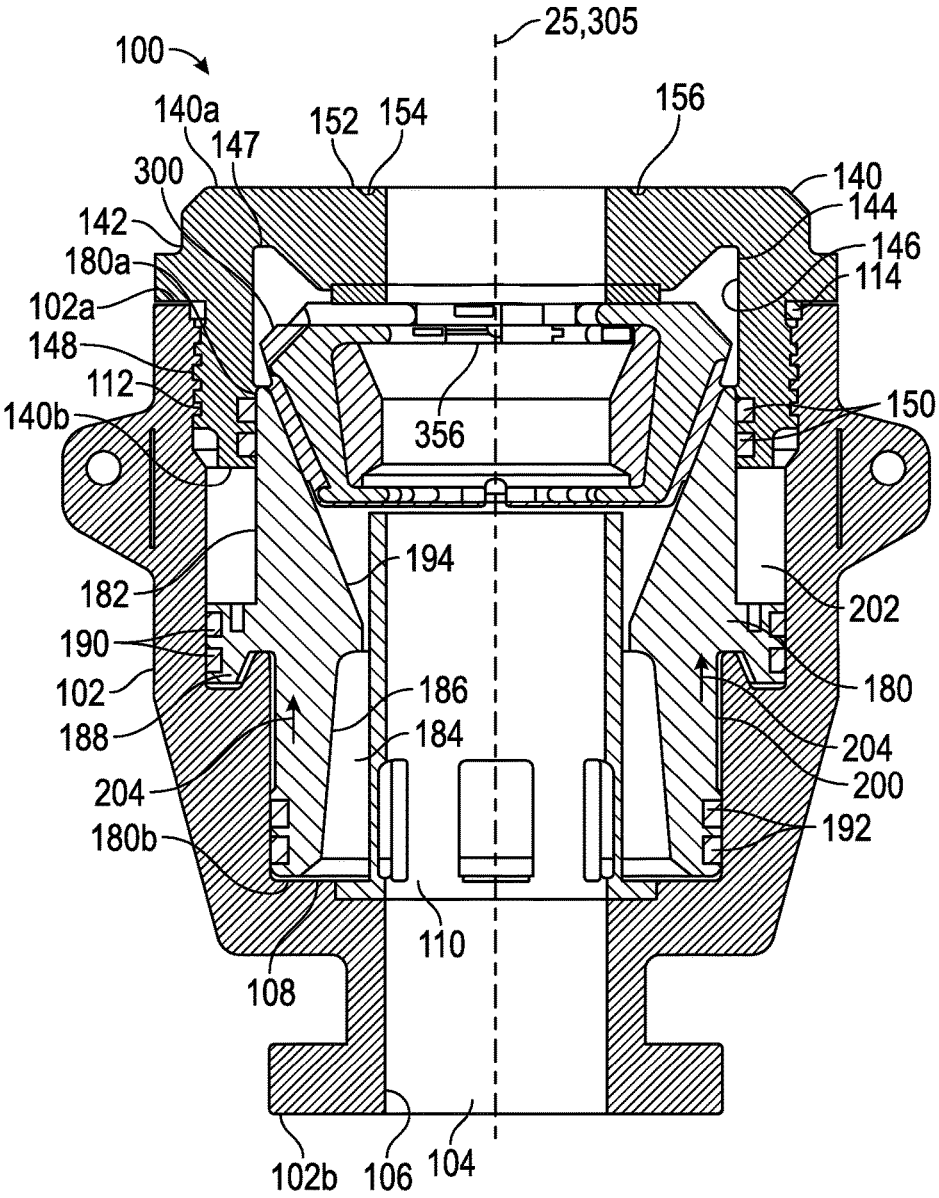
FIG. 2 is a schematic, side cross-sectional view of an embodiment of the BOP of the well system shown in FIG. 1 disposed in a first position in accordance with principles disclosed herein.
Figure 3:
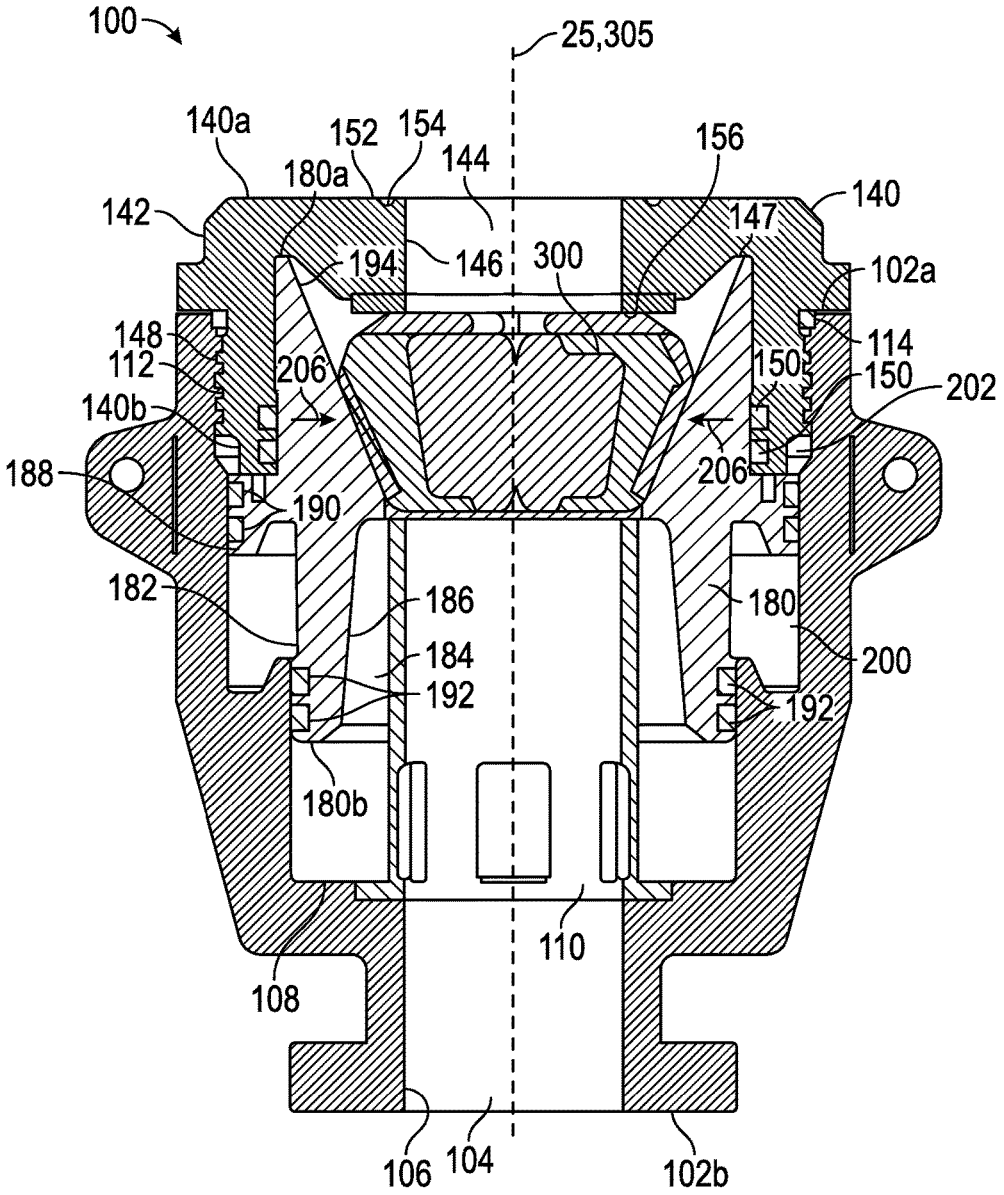
FIG. 3 is a schematic, side cross-sectional view of the of the BOP shown in FIG. 2 disposed in a second position.

Referring to FIGS. 2 and 3, schematic, cross-sectional views of annular BOP 100 of the well system 10 are shown. Given that FIGS. 2 and 3 are schematic illustrations of BOP 100, BOP 100 may include additional components or features not shown in FIGS. 2 and 3. Further, while BOP 100 is shown as part of well system 10, BOP 100 may be utilized in other well systems, including land-based well systems. In the embodiment shown in FIGS. 2 and 3, annular BOP 100 has a central or longitudinal axis coaxial with longitudinal axis 25 and generally includes a housing 102, a top 140, a piston 180, and an elastomeric packer 300. Housing 102 is configured to receive piston 180 and has a first or upper end 102*a*, a second or lower end 102*b*, and a central bore 104 extending between ends 102*a* and 102*b* and defined by an inner surface 106. In this embodiment, the inner surface 106 of bore 104 includes a radially extending annular shoulder 108 that receives and couples with a lower end of an axially extending, generally cylindrical mandrel 110 disposed in bore 104. The inner surface 106 of housing 102 also includes a threaded coupler 112 disposed thereon and an annular seal 114 disposed therein, where both coupler 112 and annular seal 114 are disposed proximal the upper end 102*a* of housing 102.

Top 140 of annular BOP 100 releasably couples to the upper end 102*a* of housing 102 and is configured for housing piston 180 and elastomeric packer 300 therein. Although in this embodiment annular BOP 100 includes top 140 releasably coupled to a housing 102, in other embodiments, housing 102 and top 140 may comprise a single, unitary component. In the embodiment shown in FIGS. 2 and 3, top 140 has a first or upper end 140*a*, a second or lower end 140*b*, an outer surface 142 extending between ends 140*a* and 140*b*, and a central bore 144 extending between ends 140*a* and 140*b* and defined by an inner surface 146. The inner surface 146 of top 140 includes an annular shoulder 147 facing lower end 140*b* of top 140. The outer surface 142 of top 140 includes a threaded coupler 148 for threadably connecting with coupler 112 of housing 102. When top 140 is connected with housing 102 the annular seal 114 of housing 102 sealingly engages the outer surface 142 of top 140. In the embodiment shown, the inner surface 146 of the bore 144 of top 140 includes a pair of annular seals 150 disposed proximal lower end 140*b* for sealing against piston 180. In addition, inner surface 146 includes a radially extending annular surface 152 proximal upper end 140*a* of top 140, which receives and couples with an annular wear plate 154. Wear plate 154 is configured to physically engage packer 300 in response to the actuation of annular BOP 100, thereby acting sacrificially to protect top 140 from wear during operation of BOP 100. As will be discussed further herein, wear plate 154 includes a lower annular surface 156 and is configured to physically engage and guide the displacement of elastomeric packer 300 as annular BOP 100 is actuated between a first or open position shown in FIG. 2, and a second or closed position shown in FIG. 3. In some embodiments, wear plate 154 may be incorporated with top 140 to form a single unitary member.

Piston 180 of annular BOP 100 is slidably disposed within the bore 104 of housing 102 and is configured to actuate BOP 100 between the open and closed positions in response to the communication of fluid pressure to bore 104 from hydraulic pressure sources (e.g., hydraulic accumulators, bottles, etc.) disposed either proximal BOP stack 11 or from platform 20. In the embodiment shown in FIG. 2, piston 180 has a first or upper end 180*a*, a second or lower end 180*b*, an outer surface 182 extending between ends 180*a* and 180*b*, and a central bore 184 extending between ends 180*a* and 180*b* defined by an inner surface 186. Outer surface 182 of piston 180 includes a radially outwards extending flange 188 and a pair of first or upper annular seals 190 disposed therein, where upper seals 190 sealingly engage the inner surface 106 of the bore 104 of housing 102. Additionally, the outer surface 182 of piston 180 includes a pair of second or lower annular seals 192 disposed proximal lower end 180*b* and similarly configured to sealingly engage the inner surface 106 of housing 102.

In the embodiment shown in FIGS. 2 and 3, the inner surface 186 of piston 180 includes an inclined or angled section 194 (i.e., disposed at a non-orthogonal angle relative longitudinal axis 25 of BOP 100) extending axially from upper end 180*a*, where inclined surface 194 physically engages the elastomeric packer 300. Particularly, inclined surface 194 is disposed at an acute angle relative longitudinal axis 25. Inclined surface 194 is configured to translate an axially directed force against piston 180 provided by hydraulic pressure within bore 104 of housing 102 into a radially directed force against packer 300 for sealing bore 144 of top 140 and bore 104 of housing 102. As shown in FIGS. 2 and 3, mandrel 110 is configured to protect or guard piston 180 from a tubular member (e.g., a drill string) extending through annular BOP 100, especially if the tubular member becomes angularly misaligned with the longitudinal axis 25 of annular BOP 100.

Figure 4:
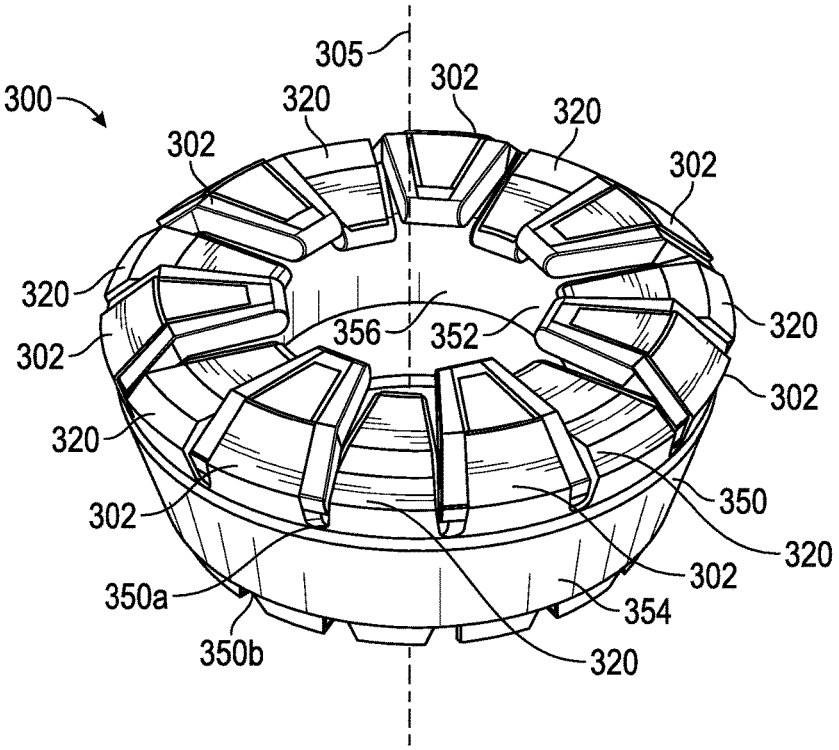
FIG. 4 is a perspective view of an embodiment of an elastomeric packer of the BOP shown in FIG. 2 disposed in the first position in accordance with principles disclosed herein.
Figure 5:
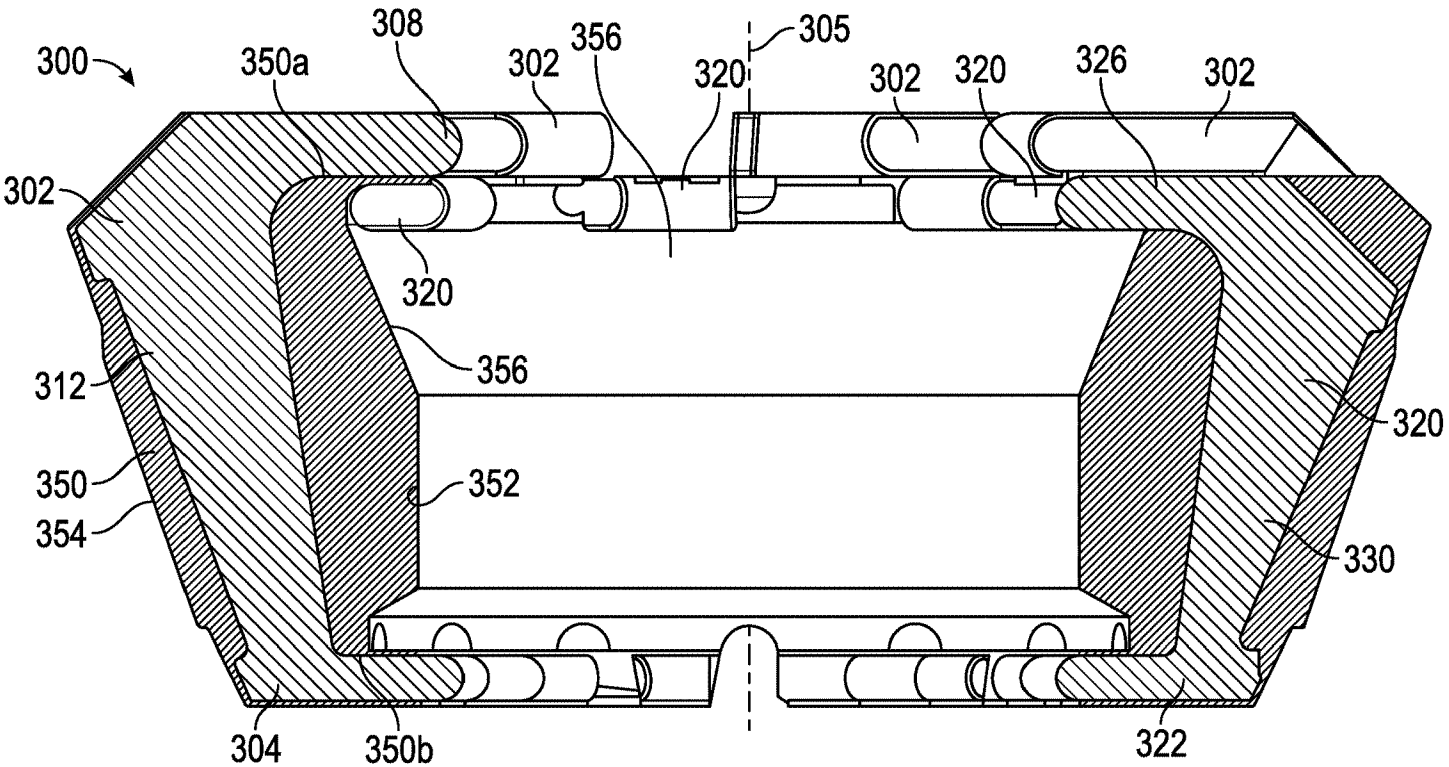
FIG. 5 is a side cross-sectional view of the packer of FIG. 4 disposed in the first position.
Figure 6:
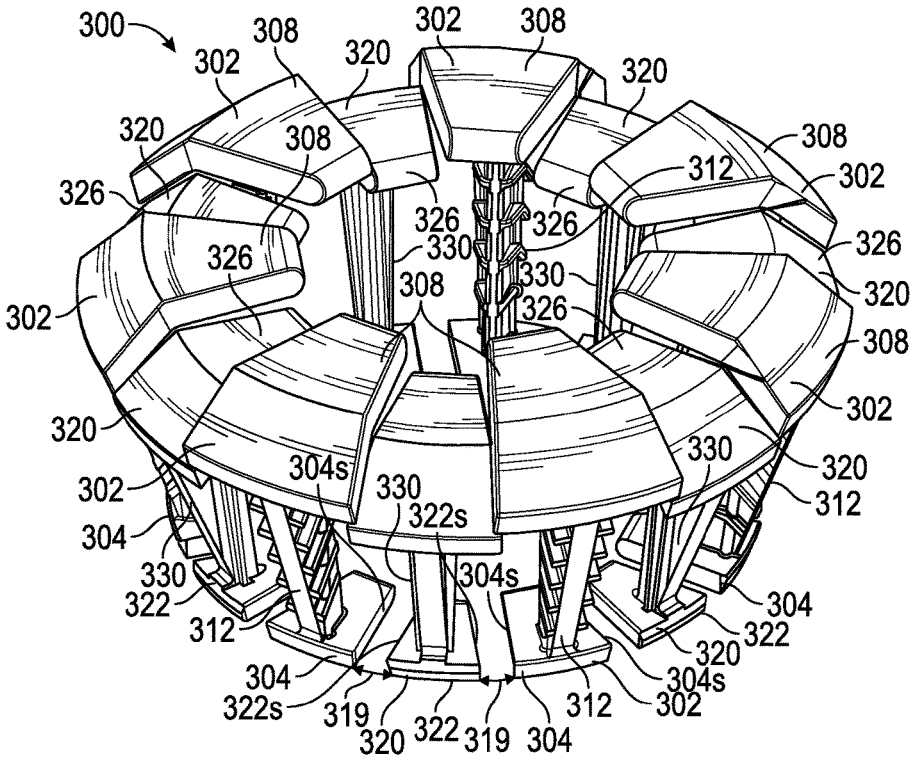
FIG. 6 is a perspective view of an embodiment of a plurality of inserts of the packer shown in FIG. 4 disposed in the first position in accordance with principles disclosed herein.
Figure 7:
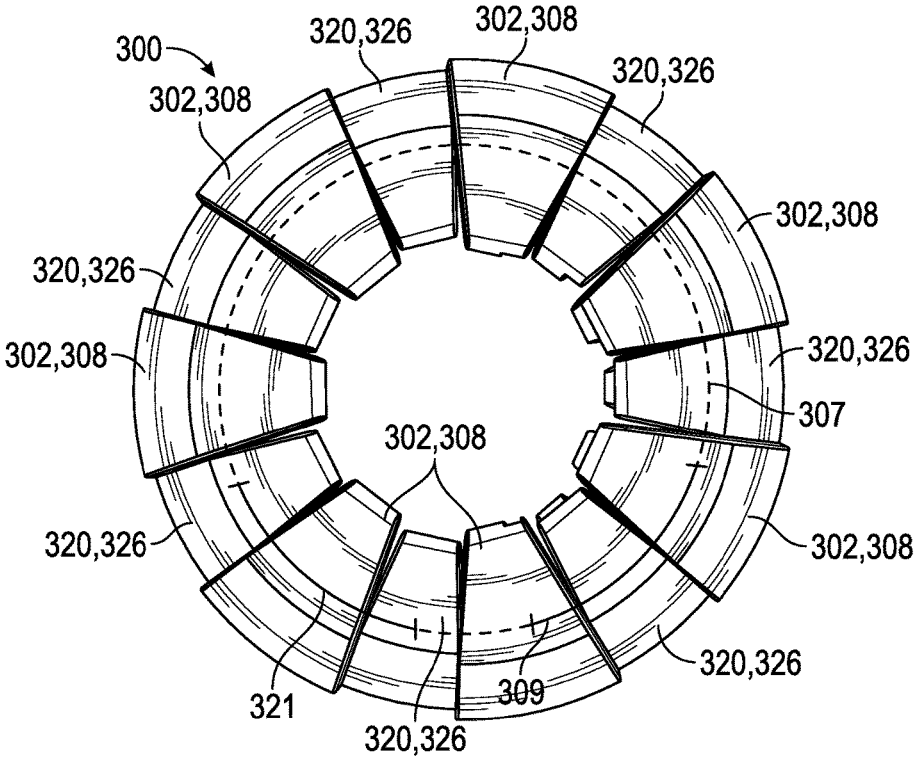
FIG. 7 is a top view of the inserts shown in FIG. 6 disposed in the first position.
Figure 8:
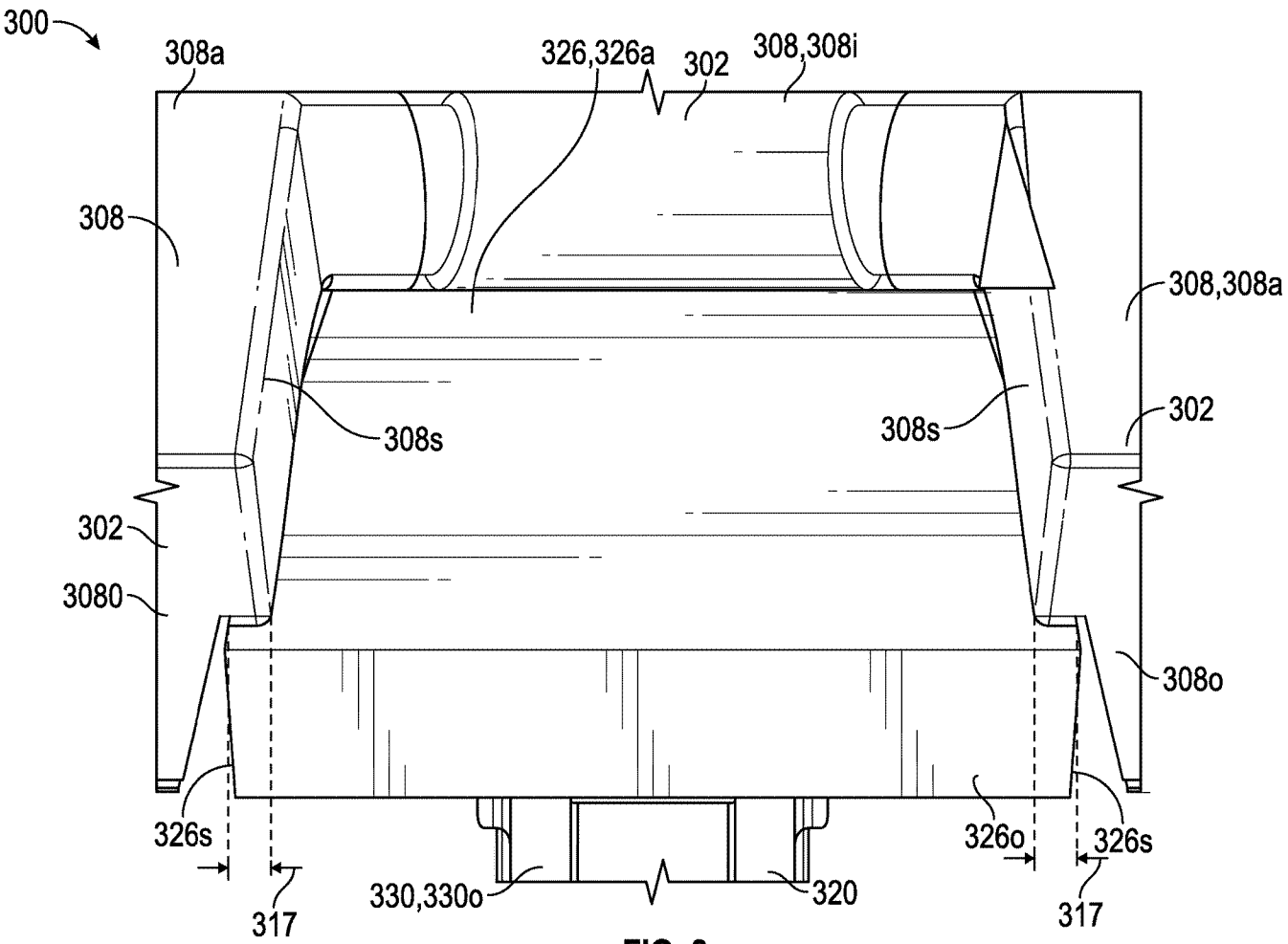
FIG. 8 is a zoomed-in side view of the inserts shown in FIG. 6 disposed in the first position.

Referring to FIGS. 4-8, elastomeric packer 300 of annular BOP 100 is shown in an open position, corresponding to the open position of annular BOP 100 shown in FIG. 2, where fluid communication is provided through BOP 100. In the embodiment shown in FIGS. 4-8, elastomeric packer 300 has a central or longitudinal axis 305 and generally includes a plurality of circumferentially spaced first or long inserts 302, a plurality of circumferentially spaced second or short inserts 320, and an annular elastomeric body 350 coupled to the long inserts 302 and short inserts 320. FIGS. 4 and 5 illustrate inserts 302, 320, and body 350, while FIGS. 6-8 illustrate packer 300 with elastomeric body 350 hidden to aid in illustrating the positioning of inserts 302 and 320 therein. In certain embodiments, long inserts 302 and short inserts 320 comprise a metallic material while elastomeric body 350 comprises an elastomeric material. In some embodiments, elastomeric packer 300 is formed via circumferentially positioning long inserts 302 and 320 within a mold, and flowing an elastomeric material into the mold to form elastomeric body 350 and thereby mold or couple body 350 to inserts 302 and 320.

As shown particularly in FIG. 7, both long inserts 302 and short inserts 320 are circumferentially spaced along a common circular circumference 307. In this arrangement, a short insert 320 is disposed between each adjacent pair of circumferentially spaced long inserts 302, and a long insert 302 is disposed between each adjacent pair of circumferentially spaced short inserts 320, forming an alternating pattern of a short insert 320 directly following each long insert 302 and a long insert 302 directly following each short insert 320 moving along the circumference 307. Each adjacent pair of long inserts 302 is circumferentially spaced between an arcuate length 309 (shown in FIG. 7) while each pair of adjacent short inserts 320 is circumferentially spaced between an arcuate length 321 (shown in FIG. 7), where arcuate length 309 is substantially equal to arcuate length 321.

Figure 9:
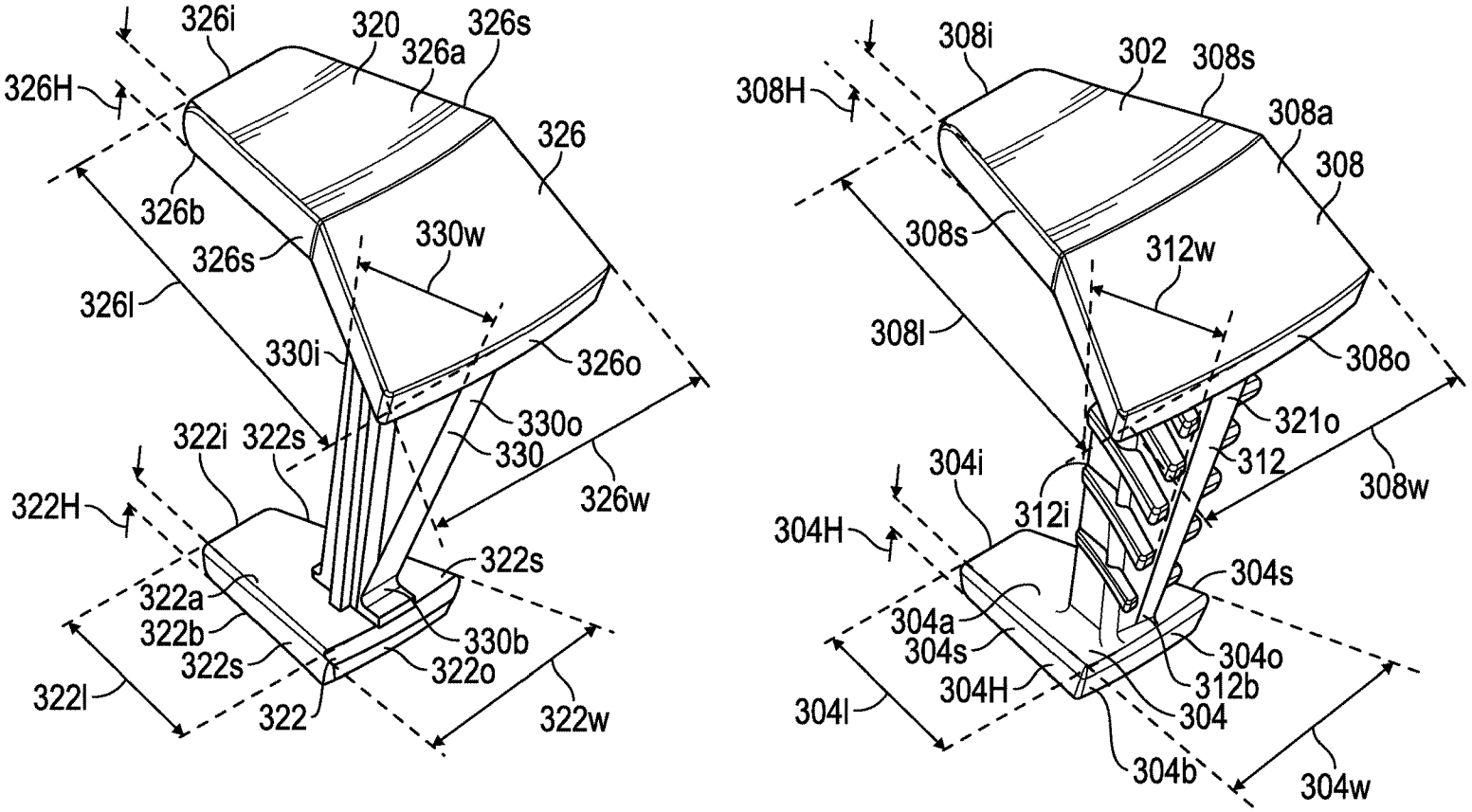
FIG. 9 is a perspective view of an embodiment of a first insert and an embodiment of a second insert of the plurality of inserts shown in FIG. 6.
Figure 10:
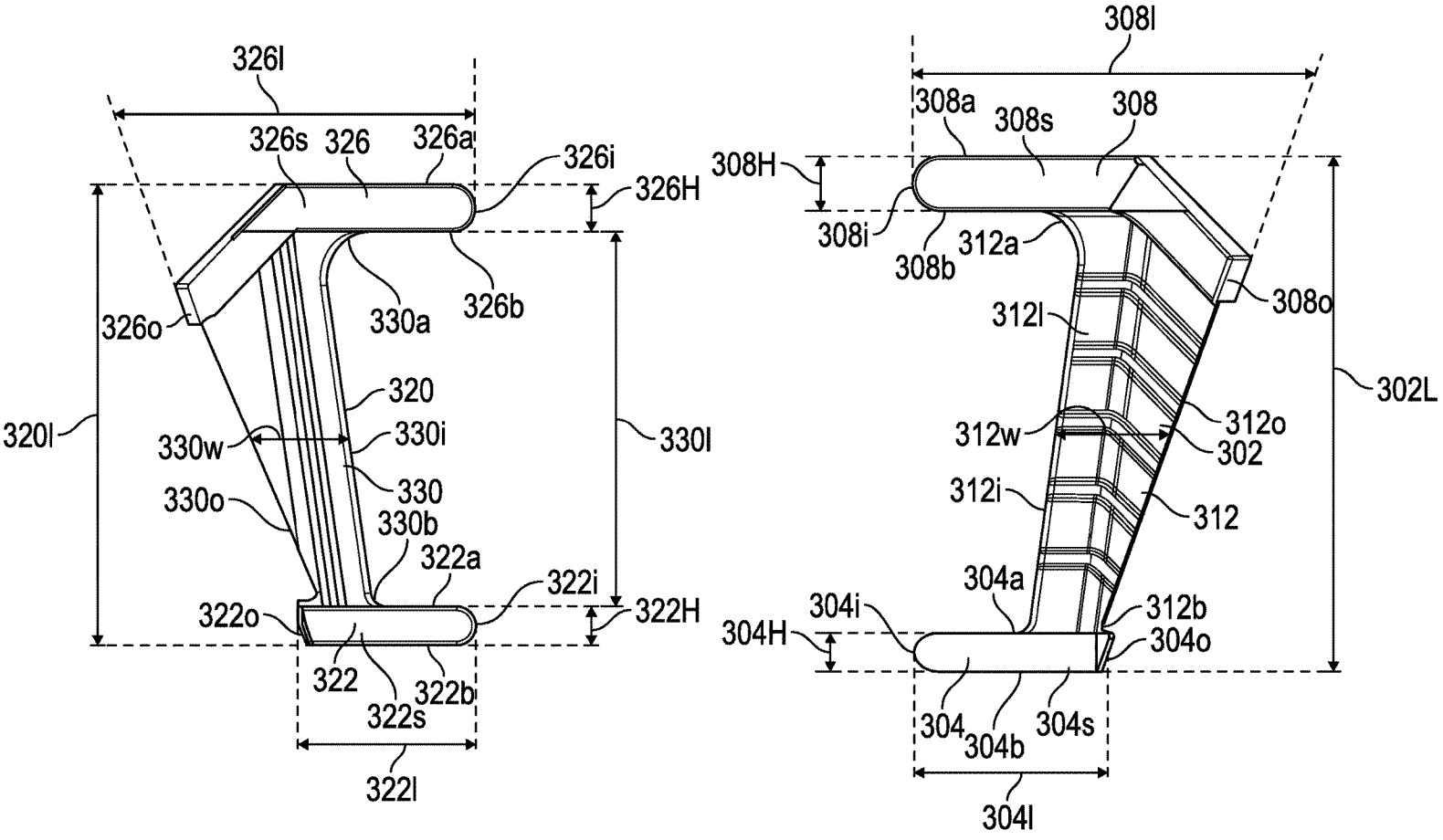
FIG. 10 is a side view of the first insert and second insert shown in FIG. 9.

Referring to FIGS. 9 and 10, an individual long insert 302 of the plurality of long inserts 302 and an individual short insert 320 of the plurality of short inserts 320 of elastomeric packer 300 are shown. Each long insert 302 of elastomeric packer 300 includes a lower flange member 304, an upper flange member 308, and a rib member 312 extending between and coupling with the lower and upper flange members 304 and 308. Lower flange 304 of long insert 302 provides structural support to packer 300 and has a first or upper end 304*a*, and a second or lower end 304*b* defining a lower end of long insert 302. Lower flange 304 has a radial length 304L extending between a radially inner (respective longitudinal axis 305) end 304*i* and a radially outer end 304*o* that is greater than a height 304H extending between upper end 304*a* and lower end 304*b*. Lower flange 304 additionally includes a circumferential width 304W extending between a pair of lateral sides 304*s* of lower flange 304.

The upper flange 308 of each long insert 302 provides additional structural support to packer 300 and includes a first or upper end 308*a* defining an upper end of long insert 302, and a second or lower end 308*b*. Upper flange 308 has a radial length 308L extending between a radially inner end 308*i* and a radially outer end 308*o* that is greater than a height 308H of upper flange 308 that extends between upper end 308*a* and lower end 308*b*. Upper flange 308 additionally includes a circumferential width 308W extending between a pair of lateral sides 308*s* of lower flange 308. The rib 312 of each long insert 302 has a first or upper end 312*a* and a second or lower end 312*b*. Upper end 312*a* couples with the lower end 308*b* of upper flange 308 and the lower end 312*b* couples with the upper end 304*a* of lower flange 304. While long insert 302 is shown in FIGS. 9 and 10 as comprising a single unitary member or body, in other embodiments, lower flange 304, upper flange 308, and rib 312 may comprise separate or distinct members or bodies. Additionally, in this embodiment rib 312 includes an axial length 312L extending between upper end 312*a* and lower end 312*b* that is greater than a radial width 312W that extends between a radially inner end 312*i* and a radially outer end 312*o* of rib 312. Thus, while lower flange 304 and upper flange 308 each include a radial length greater than a respective height, rib 312 conversely includes an axial length greater than a respective radial width.

Each short insert 320 of elastomeric packer 300 includes a lower flange member 322, an upper flange member 326, and a rib member 330 extending between and coupling the lower and upper flange members 322 and 326. Lower flange 322 of short insert 320 provides structural support to packer 300 and has a first or upper end 322*a*, and a second or lower end 322*b* defining a lower end of short insert 320. Lower flange 322 has a radial length 322L extending between a radially inner end (respective longitudinal axis 305) 322*i* and a radially outer end 322*o* that is greater than a height 322H extending between upper end 322*a* and lower end 322*b*. Lower flange 322 additionally includes a circumferential width 322W extending between a pair of lateral sides 322*s* of lower flange 322.

The upper flange 326 of each short insert 320 provides additional structural support to packer 300 and includes a first or upper end 326*a* defining an upper end of short insert 320, and a second or lower end 326*b*. Upper flange 326 has a radial length 326L extending between a radially inner end 326*i* and a radially outer end 326*o* that is greater than a height 326H of upper flange 326 that extends between upper end 326*a* and lower end 326*b*. In this embodiment, the radial length 308L of the upper flange 308 of long insert 302 is greater in length than the radial length 326L of the upper flange 326 of short flange 320. Upper flange 326 additionally includes a circumferential width 326W extending between a pair of lateral sides 326*s* of upper flange 326, where the circumferential width 326W of upper flange 326 has a lesser circumferential or arcuate length than the circumferential width 308W of the upper flange 308 of long insert 302. The rib 330 of each short insert 320 has a first or upper end 330*a* and a second or lower end 330*b*. Upper end 330*a* couples with the lower end 326*b* of upper flange 326 and the lower end 330*b* couples with the upper end 322*a* of lower flange 322. While short insert 320 is shown in FIGS. 9 and 10 as comprising a single unitary member or body, in other embodiments, lower flange 322, upper flange 326, and rib 330 may comprise separate or distinct members or bodies.

Additionally, in this embodiment rib 330 includes an axial length 330L extending between upper end 330*a* and lower end 330*b* that is greater than a radial width 330W that extends between a radially inner end 330*i* and a radially outer end 330*o* of rib 330. Thus, while lower flange 322 and upper flange 326 each include a radial length greater than a respective height, rib 330 conversely includes an axial length greater than a respective radial width. Further, the axial length 312L of the rib 312 of each long insert 302 is greater in length than the axial length 330L of the rib 330 of each short insert 320. Each long insert 302 of packer 300 includes an overall axial length 302L extending between the upper end 308*a* of upper flange 308 and the lower end 304*b* of lower flange 304. Each short insert 320 of packer 300 includes an overall axial length 320L extending between the upper end 326*a* of upper flange 326 and the lower end 322*b* of lower flange 322, where the axial length 302L of long insert 302 is greater in length or height than the axial length 320L of short insert 320.

Figure 11:
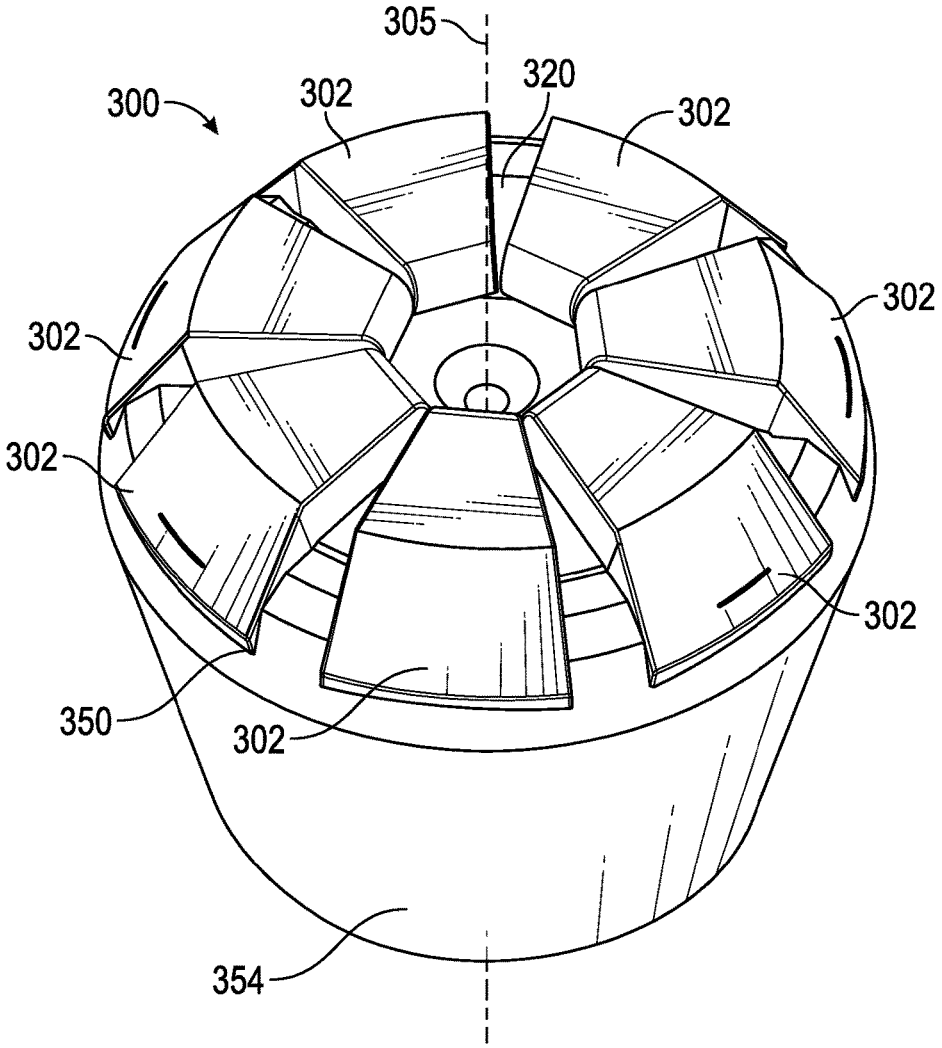
FIG. 11 is a perspective view of the packer shown in FIG. 4 disposed in the second position.
Figure 12:
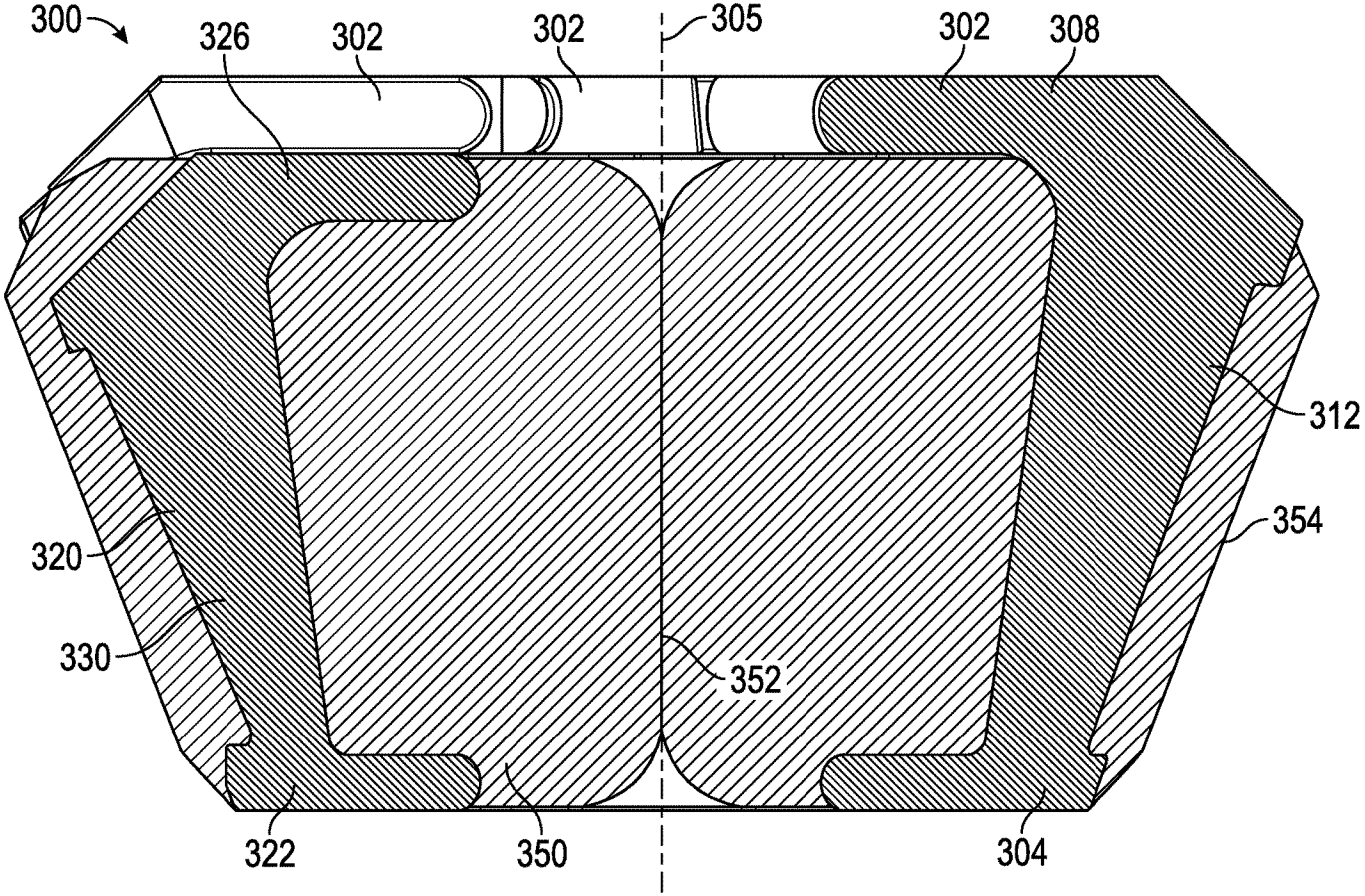
FIG. 12 is a side cross-sectional view of the packer shown in FIG. 4 disposed in a second position.
Figure 13:
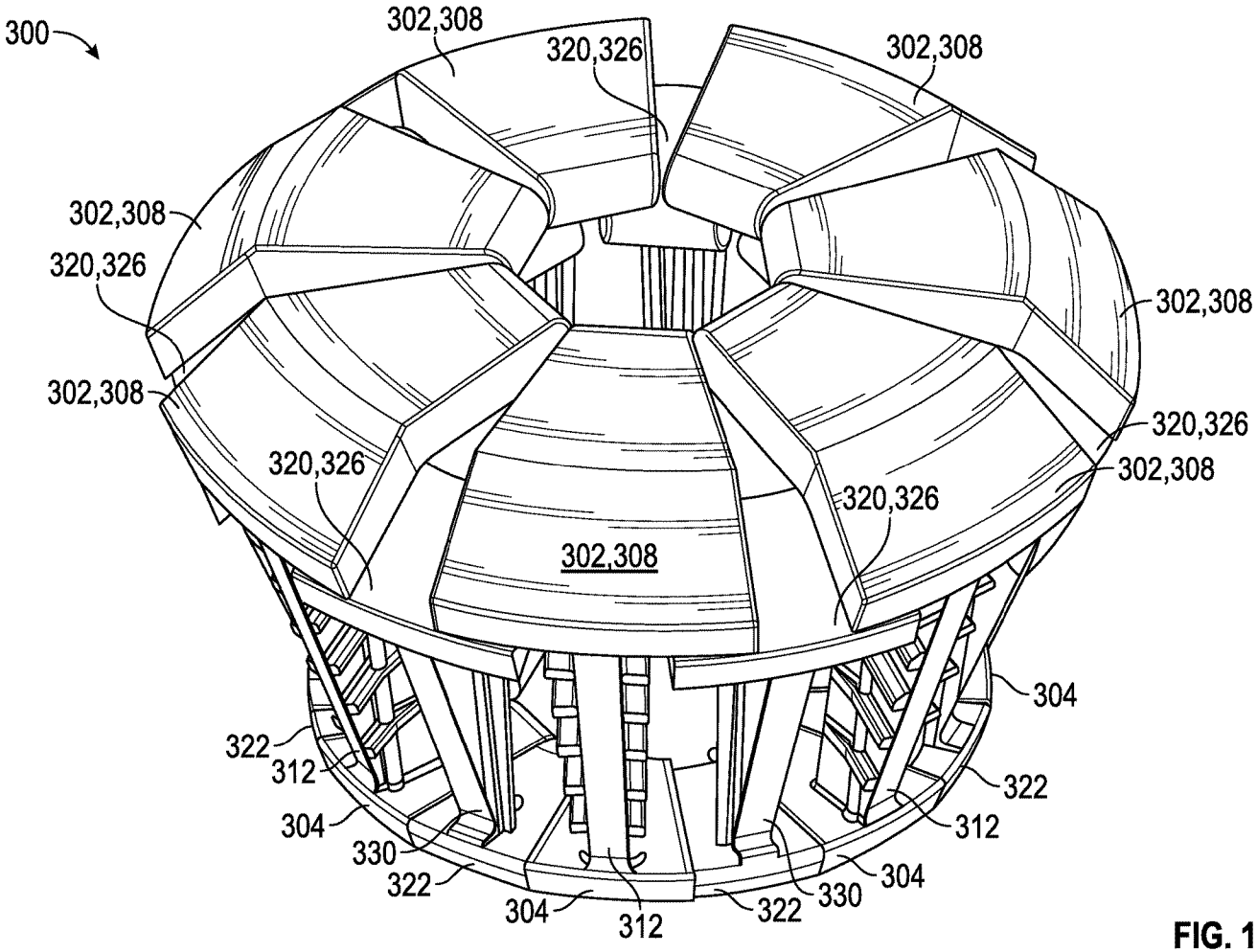
FIG. 13 is a perspective view of the inserts shown in FIG. 6 disposed in the second position.
Figure 14:
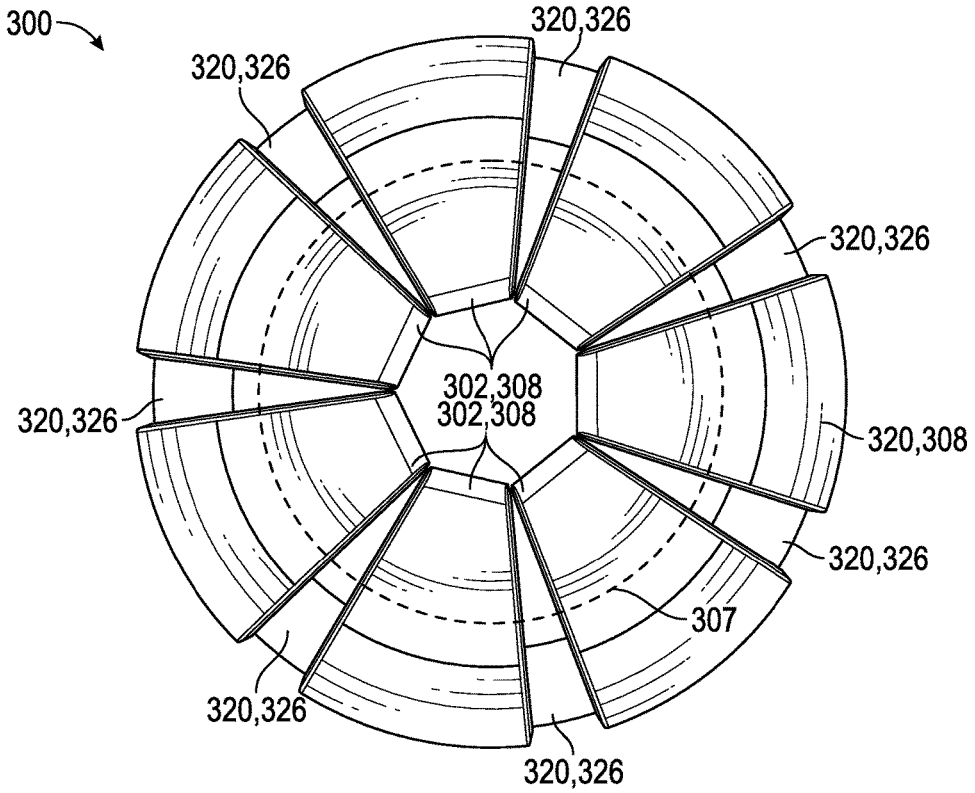
FIG. 14 is a top view of the inserts shown in FIG. 6 disposed in the second position.
Figure 15:
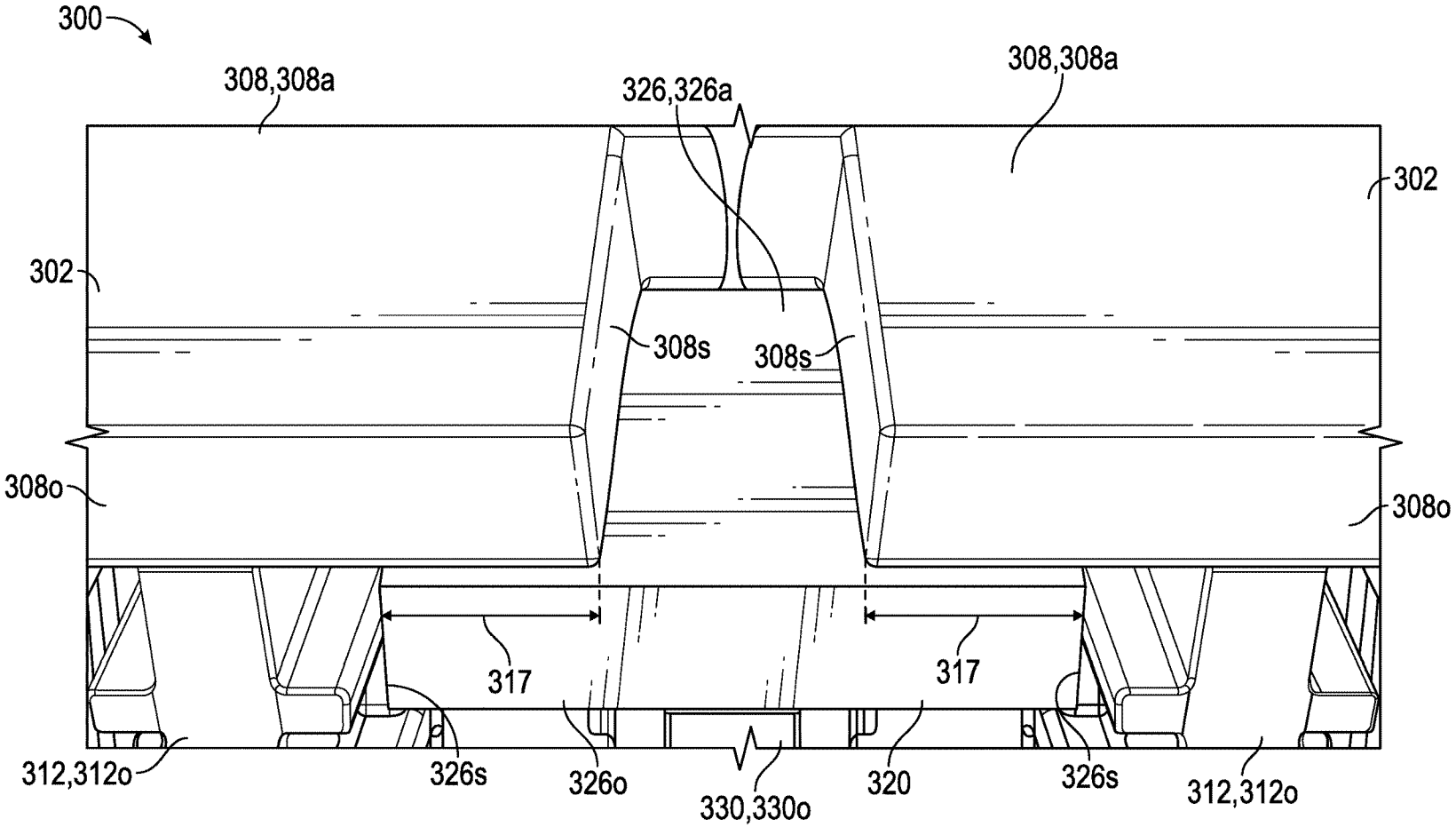
FIG. 15 is a zoomed-in side view of the inserts shown in FIG. 6 disposed in the second position.

Referring to FIGS. 4, 5, 11, and 12, FIGS. 4 and 5 illustrate packer 300 in the open position corresponding to the open position of BOP 100 shown in FIG. 2, while FIGS. 11 and 12 illustrate packer 300 in a closed position corresponding to the closed position of BOP 100 shown in FIG. 3. Long inserts 302 and short inserts 320 are configured to provide structural integrity to packer 300 and to control the deformation or flow of elastomeric body 350 when annular BOP 100 is actuated between the open and closed positions. Elastomeric body 350 of packer 300 is configured to seal bores 144 and 104 of BOP 100 when BOP 100 is disposed in the closed position, both when a tubular member extends through BOP 100 and when a tubular member does not extend through BOP 100 (as shown in FIGS. 2 and 3).

In the embodiment shown in FIGS. 4 and 5, elastomeric body 350 comprises an annular or torus shaped body having an upper 350*a*, a lower end 350*b*, a radially inner sealing surface 352 extending between ends 350*a* and 350*b*, and a radially outer sealing surface 354 extending between ends 350*a* and 350*b*. In this arrangement, inner surface 352 of elastomeric body 350 defines a central bore 356 of elastomeric packer 350. When annular BOP 100 is disposed in the open position shown in FIG. 2, bore 356 extends through packer 300, providing for fluid communication through annular BOP 100, as shown in FIGS. 4 and 5 illustrating packer 300. However, when BOP 100 is disposed in the closed position shown in FIG. 3, the inner surface 352 of elastomeric body 350 seals against itself, eliminating bore 356 of packer 300, as shown in FIGS. 11 and 12 of packer 300. With inner surface 352 of elastomeric body 350 sealing against itself, fluid communication is restricted through bores 144 and 104 of annular BOP 100.

Referring to FIGS. 2 and 4-8, when annular BOP 100 and elastomeric packer 300 are each disposed in the open position a first arcuate overlap 317 (shown in FIG. 8) extends between the upper flange 326 (measured from the lateral sides 326*s* of upper flange 326) of each short insert 320 and the upper flange 308 (measured from the lateral sides 308*s* of upper flange 308) of each long insert 302 disposed directly adjacent the short insert 320. Specifically, first arcuate overlap 317 extends between the lateral side 326*s* of the upper flange 326 of each short insert 320 and the adjacent lateral side 308*s* of the upper flange 308 of the adjacent long insert 302, respectively, at the radially outer end 326*o* and 308*o* of the upper flange 326 and upper flange 308 of short insert 320 and long insert 302. In other words, at the radially inner end 326*i* and 308*i* of the upper flange 326 and upper flange 308 of short insert 320 and long insert 302, each lateral side 326*s* of the upper flange 326 do not arcuately overlap with the adjacent lateral side 308*s* of the adjacent upper flange 308 (i.e., an arcuate gap extends therebetween at the radially inner ends 326*i* and 308*i*).

However, the arcuate gap extending between the lateral side 326*s* (at the radially inner end 326*i*) of short insert 326 and the adjacent lateral side 308*s* (at the radially inner end 308*i*) of an adjacently positioned long insert 308 is minimized or reduced. In other embodiments, arcuate overlap 317 may radially extend along the entire radial length 326L of each upper flange 326. In still other embodiments, when BOP 100 and packer 300 are each disposed in the open position, an arcuate gap may radially extend along the entire radial length disposed between adjacent short inserts 320 and long inserts 308. Additionally, when BOP 100 and packer 300 are each disposed in the open position, an arcuate gap 319 (shown in FIG. 6) extends between each side 322*s* of the lower flange 322 of each short insert 320 and each adjacently positioned side 304*s* of the lower flange 304 of the pair of long inserts 308 adjacently flanking the short insert 320.

Referring to FIGS. 3 and 11-15, when annular BOP 100 and elastomeric packer 300 are each disposed in the closed position a second arcuate overlap 323 (shown in FIG. 15) extends between the upper flange 326 (measured from the lateral sides 326*s* of upper flange 326) of each short insert 320 and the upper flange 308 (measured from the lateral sides 308*s* of upper flange 308) of each long insert 302 disposed directly adjacent the short insert 320. The second arcuate overlap 323, corresponding to the closed position of BOP 100 and packer 300, is greater in arcuate or circumferential length then the first arcuate overlap 317 shown in FIG. 8, which corresponds to the open position of BOP 100 and packer 300. Moreover, unlike first arcuate overlap 317, second arcuate overlap 323 radially extends across the entire radial length 326L. In other words, the radial length 326L of each lateral side 326*s* of the upper flange 326 of each short insert 320 is covered or overlapped by the adjacent lateral side 308*s* of the upper flange 308 of an adjacently positioned long insert 302. First arcuate overlap 317 and second arcuate overlap 323 are provided by the relatively greater height 312H of the rib 312 of long insert 302 than the height 330H of the rib 330 of short insert 320. Arcuate overlaps 317 and 323 are also provided by the relatively greater width 308W of the upper flange 308 of long insert 302 than the width 326W of the upper flange 326 of short insert 320. In this arrangement, the greater width 308W of upper flanges 308 allow for flanges 308 to arcuately extend over upper flanges 326 while the greater height 312H of rib 312 allows for upper flanges 326 to fit arcuately between the ribs 312 of the adjacently flanking long inserts 302.

Additionally, when BOP 100 and packer 300 are each disposed in the closed position, the arcuate gap 319 extending between the lower flange 322 of short inserts 320 and the lower flange 304 of adjacently positioned long inserts 302 is reduced or substantially eliminated (shown in FIG. 13) in response to a decrease in the circumferential length of common circumference 307. Thus, in the closed position, each lower flange 322 physically engages or is disposed directly adjacent an adjacently positioned lower flange 304. Further, when BOP 100 and packer 300 are each disposed in the closed position, bore 356 is substantially reduced or eliminated (shown in FIG. 12), with inner surface 352 of elastomeric body 350 sealing against itself to restrict fluid communication through bore 356.

Referring to FIG. 2-15, annular BOP 100 and elastomeric packer 300 may be actuated between their respective open and closed positions in response to the selective pressurization of bore 104 of housing 102. Specifically, the sealing engagement provided by upper annular seals 190 and lower annular seals 192 of piston 180 define an annular first or closing chamber 200 within bore 104 of housing 102 that extends axially between seals 190 and 192. Additionally, the annular seals 150 of top 140 sealingly engage the outer surface 182 of piston 180. Sealing engagement provided by seals 150 of top 140 and the upper seals 190 of piston 180 define an annular second or opening chamber 202 within bore 104 of housing 102 that extends axially between seals 150 and 190. Annular BOP 100 is shown in the open position in FIG. 2, where fluid communication is allowed or provided through bore 104 of housing 102 and bore 144 of top 140.

In the open position shown in FIG. 2, the lower end **180*b* of piston 180 physically engages or is disposed directly adjacent annular shoulder 108 while upper end 180*a* is axially spaced from the annular shoulder 147 of top 140. In addition, an outer surface of elastomeric packer 300 engages the inclined surface 194 of piston 180 proximal upper end 180*a* such that packer 300 extends axially from the bore 184 of piston 180. In the closed position shown in FIG. 3, the upper end 180*a* of piston 180 physically engages or is disposed directly adjacent the annular shoulder 147 of top 140 while lower end 140*b* is axially spaced from the annular shoulder 180 of housing 102. Additionally, the outer surface of packer 300 engages a lower end of inclined surface 194 of piston 180 such that packer 300 does not extend axially from bore 184 of piston 180**.

Annular BOP 100 may be actuated from the open position shown in FIG. 2, where fluid communication is provided through bores 144 and 104 of top 140 and housing 102, respectively, to the closed position shown in FIG. 3, where fluid communication is restricted through bores 144 and 104 of top 140 and housing 104. Specifically, to actuate annular BOP 100 to the closed position shown in FIG. 3 closing chamber 200 of bore 104 is hydraulically pressurized while hydraulic pressure within opening chamber 202 is concurrently reduced, thereby providing a hydraulic pressure closing force against piston 180 (shown schematically by arrow 204 in FIG. 2). Closing force 204 is axially directed towards the upper end **140*a* of top 140, causing piston 180 to be displaced axially upwards within bore 140 until annular BOP 100** is disposed in the closed position.

While piston 180 is displaced upwardly as BOP 100 is actuated from the open position to the closed position, axial movement of packer 300 within BOP 100 is restricted via physical engagement from the lower surface 156 of wear plate 154. Thus, the relative axial movement between packer 300 and piston 180 results in the application of a radially inwards directed force (shown schematically by arrow 206 in FIG. 3) against the outer surface of packer 300. The application of radial force 206 forces a central bore of packer 300 to close, thereby restricting fluid communication between through annular BOP 100. Although FIG. 3 illustrates annular BOP 100 disposed in a closed position where a tubular member does not extend through BOP 100, in other embodiments, the closed position of BOP 100 may include sealing against an outer surface of a tubular member extending through BOP 100 to restricted fluid communication therethrough.

Conversely, annular BOP 100 may be actuated from the closed position to the open position shown in FIG. 2 by hydraulically pressurizing opening chamber 202 while concurrently depressurizing closing chamber 200. The pressurization of opening chamber 202 and depressurization of closing chamber 200 provides an axially directed opening force against piston 180, causing piston 180 to be displaced through bore 104 of housing 102 until annular BOP 100 is disposed in the open position with the lower end **180*b* in physical engagement with or disposed directly adjacent the annular surface 108 of housing 102. Fluid pressure may be communicated to chambers 200 and 202 via ports (not shown) extending radially through housing 102, where each port is in fluid communication with a hydraulic pressure source, such as a pressure source provided at platform 20**.

In traditional annular BOPs comprising traditional elastomeric packers, an arcuate gap is maintained between each of a plurality of inserts comprising the packer as the packer is actuated between open and closed positions. In this arrangement, elastomeric material comprising the elastomeric body of the traditional packer is extruded between each insert through the aforementioned arcuate gaps in response to the radially inwards directed force provided by the piston of the traditional annular BOP. For example, the elastomeric material may flow through the arcuate gaps such that the material is disposed axially above or below the plurality of circumferentially spaced inserts. The extrusion of elastomeric material in traditional BOPs reduces the amount of elastomeric material captured radially between the circumferentially positioned inserts and the inner surface of the elastomeric body, thereby reducing the amount of sealing pressure applied against the inner surface of the elastomeric body when the traditional BOP is actuated into the closed position.

However, in this embodiment, as packer 300 closes in response to the application of radially inwards force 206, the arcuate overlap between each adjacently disposed short insert 320 and long insert 302 increases. Particularly, the arcuate overlap is increased from the first arcuate overlap 317 shown in FIG. 8, corresponding to the open position of packer 300, to the second arcuate overlap 323 shown in FIG. 15, corresponding to the closed position of packer 300. The presence of arcuate overlaps 317 and 323 restrict or prevent the flow of elastomeric material comprising elastomeric body 350 between each adjacently disposed short insert 320 and long insert 302. Given that there is no, or at least a substantially minimized, arcuate gap between adjacently positioned upper flanges 326 and 308, the elastomeric material forming elastomeric body 350 is prevented from flowing axially (i.e., towards the upper end of packer 300) between the adjacently disposed inserts 320 and 308, respectively. In this manner, the relative increase in arcuate overlap between first overlap 317 and second overlap 323 as the packer 300 is actuated towards the closed position thereby enhances the restriction of flow or extrusion of elastomeric body 350 during the actuation of packer 300 between the open and closed positions. With the elastomeric material forming body 350 prevented from flowing between adjacently disposed inserts 320 and 308, the material forming body 350 is captured radially between the circumferentially positioned inserts 320, 302 and the inner surface 352 of body 350, thereby maintaining or enhancing the sealing pressure against inner surface 352 when packer 300 is disposed in the closed position. In turn, enhancement of the sealing pressure provided by packer 300 allows annular BOP 100 to be utilized in a wider range of environments (i.e., wider range of pressure and temperature environments) than a traditional BOP.

Figure 16:
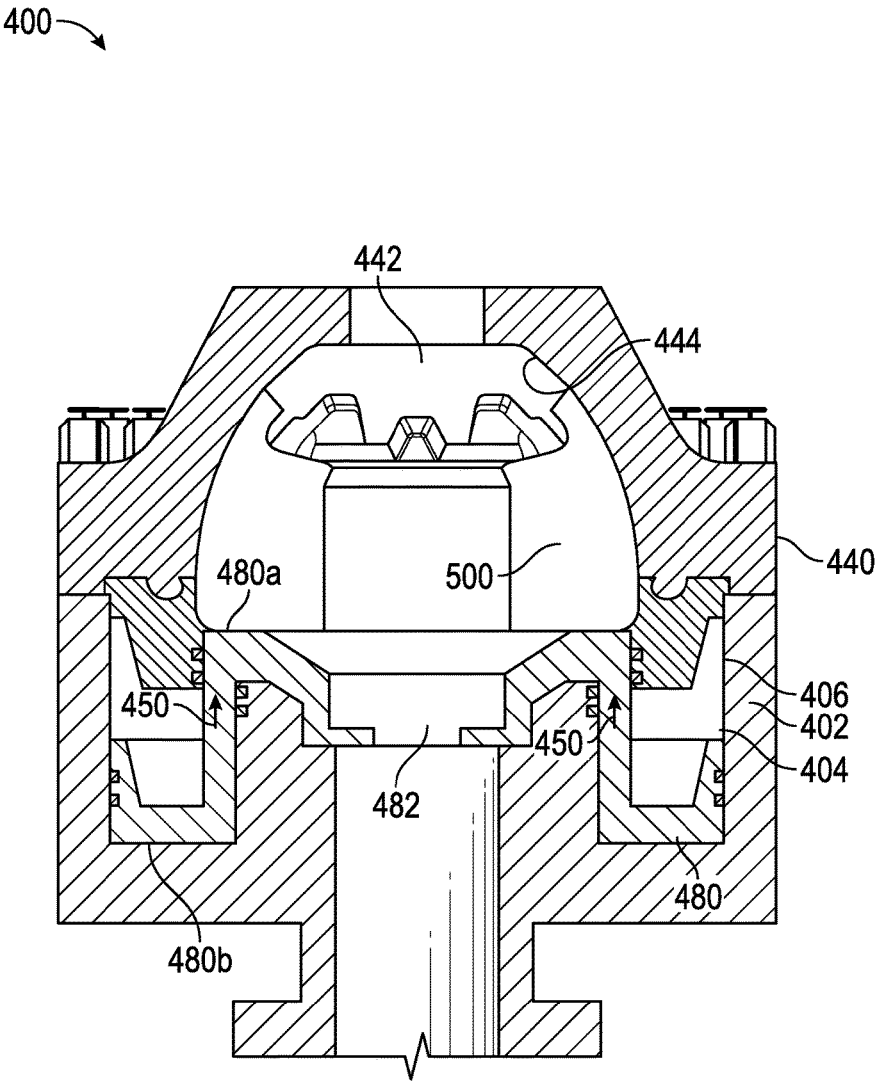
FIG. 16 is schematic, side cross-sectional view of another embodiment of the BOP of the well system shown in FIG. 1 in accordance with principles disclosed herein.

Referring to FIG. 16, another embodiment of an annular BOP 400 is shown, where BOP 400 may be used in well system 10 shown in FIG. 1, or other well systems. In the embodiment shown in FIG. 16, annular BOP 400 includes a housing 402, a top 440, a piston 480, and an elastomeric packer 500. Housing 402 is configured to receive piston 480 and has central bore 404 extending between upper and lower ends of housing 402, where bore 404 is defined by an inner surface 406. Top 440 of annular BOP 400 includes a central bore 442 extending between upper and lower ends of top 440 and is at least partially defined by a hemispherical inner surface 444. Piston 480 of annular BOP 400 is slidably disposed within the bore 404 of housing 402 and is configured to actuate BOP 400 between an open position (shown in FIG. 16) and a closed position in response to the communication of fluid pressure to bore 404 from hydraulic pressure sources (e.g., hydraulic accumulators, bottles, etc.) disposed either proximal BOP stack 11 or from platform 20. In the embodiment shown in FIG. 16, piston 480 has a first or upper end 480*a*, a second or lower end 480*b*, and a central bore 482 extending between ends 480*a* and 480*b*.

Figure 17:
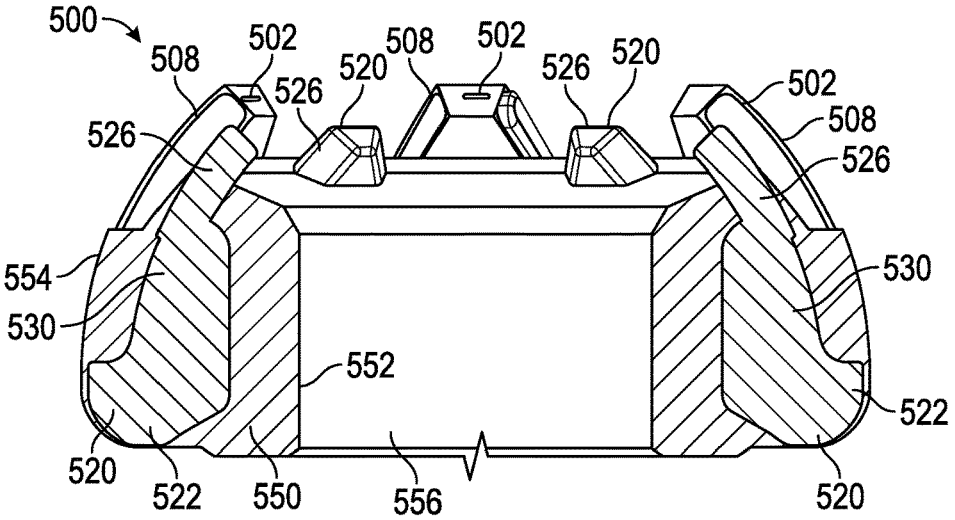
FIG. 17 is a side cross-sectional view of an embodiment of an elastomeric packer of the BOP shown in FIG. 16 disposed in a first position in accordance with principles disclosed herein.
Figure 18:
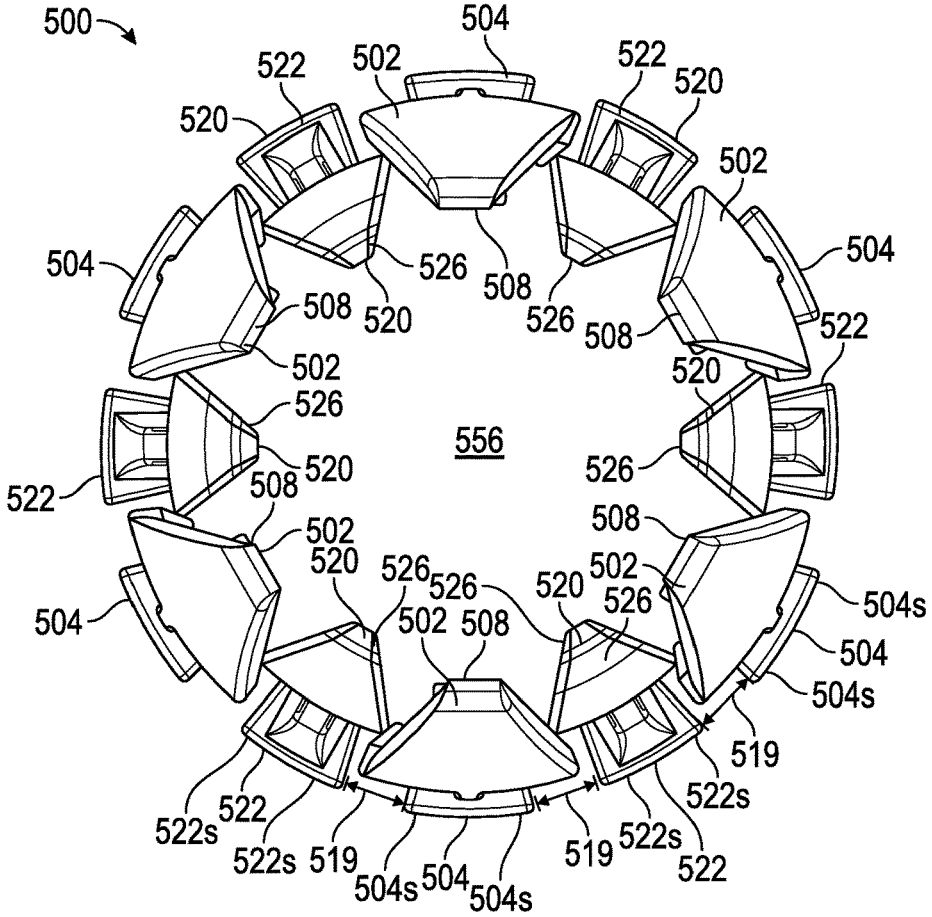
FIG. 18 is a top view of an embodiment of a plurality of inserts of the packer shown in FIG. 17 disposed in the first position in accordance with principles disclosed herein.
Figure 19:
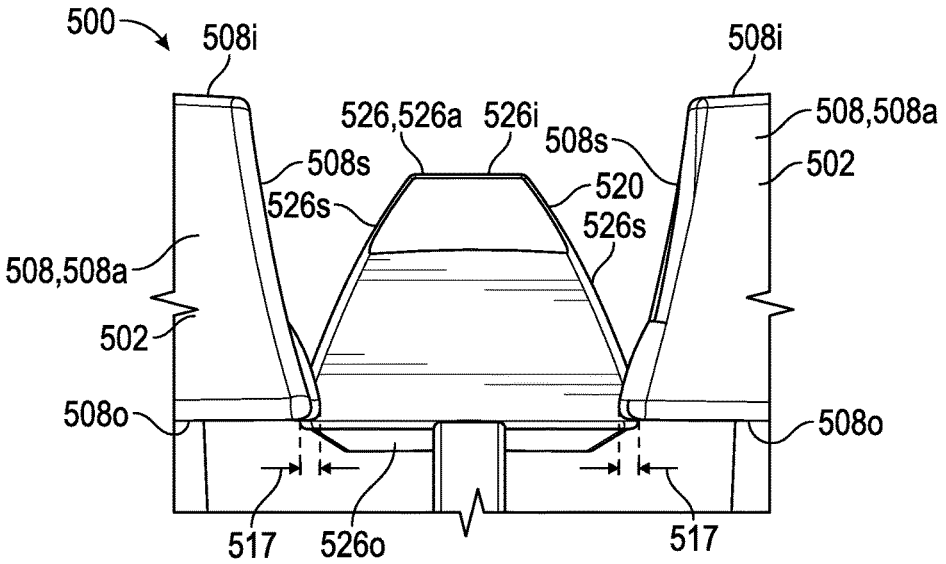
FIG. 19 is a zoomed-in side view of the inserts shown in FIG. 18 disposed in the first position.

Referring to FIGS. 17-19, elastomeric packer 500 of annular BOP 400 is shown in an open position corresponding to the open position of annular BOP 400 shown in FIG. 16, where fluid communication is provided through BOP 400. In the embodiment shown in FIGS. 17-19, elastomeric packer 500 generally includes a plurality of circumferentially spaced first or long inserts 502, a plurality of circumferentially spaced second or short inserts 520, and an annular elastomeric body 550 coupled to the long inserts 502 and short inserts 520. In this arrangement, a short insert 520 is disposed between each adjacent pair of circumferentially spaced long inserts 502, and a long insert 502 is disposed between each adjacent pair of circumferentially spaced short inserts 520, forming an alternating pattern of a short insert 520 directly following each long insert 502 and a long insert 502 directly following each short insert 520.

Figure 22:
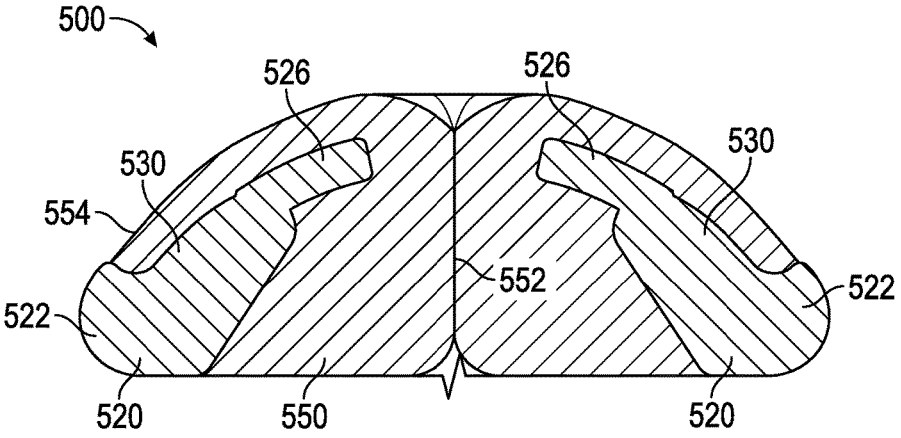
FIG. 22 is a side cross-sectional view of the packer shown in FIG. 17 disposed in a second position.

Referring to FIGS. 16, 17, and 22, elastomeric body 550 of packer 500 comprises an annular or torus shaped body having a radially inner sealing surface 552 extending between upper and lower ends of body 550. In this arrangement, inner surface 552 of elastomeric body 550 defines a central bore 556 of elastomeric packer 550. When annular BOP 400 is disposed in the open position shown in FIG. 16, bore 556 extends through packer 500, providing for fluid communication through annular BOP 400. However, when BOP 400 is disposed in the closed position, the inner surface 552 of elastomeric body 550 seals against itself, eliminating bore 556 of packer 500 (shown in FIGS. 22). With inner surface 552 of elastomeric body 550 sealing against itself, fluid communication is restricted through BOP 400.

Figure 20:
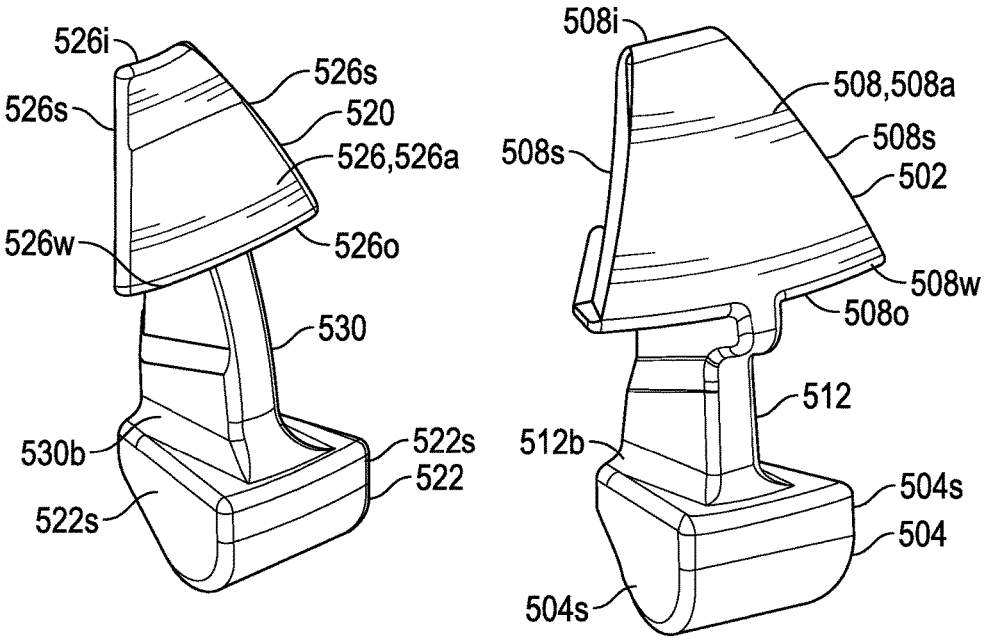
FIG. 20 is a perspective view of an embodiment of a first insert and an embodiment of a second insert of the plurality of inserts shown in FIG. 18.
Figure 21:
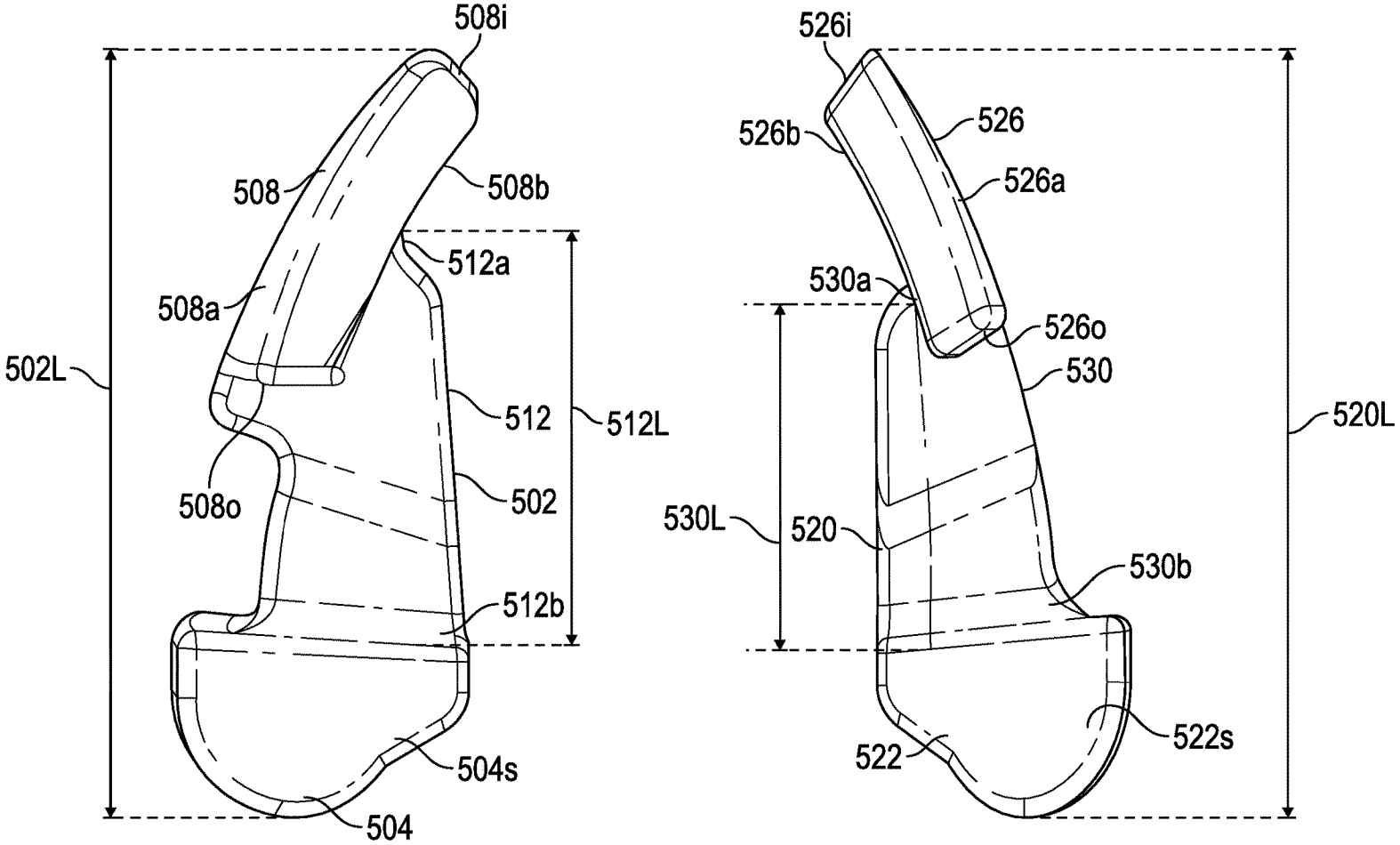
FIG. 21 is a side view of the first insert and second insert shown in FIG. 20.

Referring to FIGS. 20 and 21, an individual long insert 502 of the plurality of long inserts 502 and an individual short insert 520 of the plurality of short inserts 520 of elastomeric packer 500 are shown. Each long insert 502 of elastomeric packer 500 includes a lower flange member 504, an upper flange member 508, and a rib member 512 extending between and coupling the lower and upper flange members 504 and 508. The upper flange 508 of each long insert 502 includes a first or upper end 508*a* defining an upper end of long insert 502, and a second or lower end 508*b*. Upper flange 508 has a radial length extending between a radially inner end 508*i* and a radially outer end 508*o*. Upper flange 508 additionally includes a circumferential width 508W extending between a pair of lateral sides 508*s* of lower flange 508. The rib 512 of each long insert 502 has a first or upper end 512*a* and a second or lower end 512*b*. Upper end 512*a* couples with the lower end 508*b* of upper flange 508 and the lower end 512*b* couples with an upper end of lower flange 504. Further, in this embodiment rib 512 includes an axial length 512L extending between upper end 512*a* and lower end 512*b*.

Each short insert 520 of elastomeric packer 500 includes a lower flange member 522, an upper flange member 526, and a rib member 530 extending between and coupling the lower and upper flange members 522 and 526. The upper flange 526 of each short insert 520 includes a first or upper end 526*a* defining an upper end of short insert 520, and a second or lower end 526*b*. Upper flange 526 has a radial length extending between a radially inner end 526*i* and a radially outer end 526*o*. Upper flange 526 additionally includes a circumferential width 526W extending between a pair of lateral sides 526*s* of upper flange 526, where the circumferential width 526W of upper flange 526 has a lesser circumferential or arcuate length than the circumferential width 508W of the upper flange 508 of long insert 502. The rib 530 of each short insert 520 has a first or upper end 530*a* and a second or lower end 530*b*. Upper end 530*a* couples with the lower end 526*b* of upper flange 526 and the lower end 530*b* couples with the upper end of lower flange 522. Additionally, in this embodiment rib 530 includes an axial length 530L extending between upper end 530*a* and lower end 530*b*. The axial length 512L of the rib 512 of each long insert 502 is greater in length than the axial length 530L of the rib 530 of each short insert 530. Each long insert 502 of packer 500 includes an overall axial length 502L extending between the upper end 508*a* of upper flange 508 and the lower end of lower flange 504. Each short insert 520 of packer 500 includes an overall axial length 520L extending between the upper end 526*a* of upper flange 526 and the lower end of lower flange 522, where the axial length 502L of long insert 502 is greater in length than the axial length 520L of short insert 520.

Referring to FIGS. 17-19, when annular BOP 400 and elastomeric packer 500 are each disposed in the open position a first arcuate overlap 517 (shown in FIG. 19) extends between the upper flange 526 (measured from the lateral sides 526*s* of upper flange 526) of each short insert 520 and the upper flange 508 (measured from the lateral sides 508*s* of upper flange 508) of each long insert 502 disposed directly adjacent the short insert 520. Additionally, when BOP 400 and packer 500 are each disposed in the open position, an arcuate gap 519 (shown in FIG. 18) extends between each side 522*s* of the lower flange 522 of each short insert 520 and each adjacently positioned side 504*s* of the lower flange 504 of the pair of long inserts 508 adjacently flanking the short insert 520.

Figure 23:
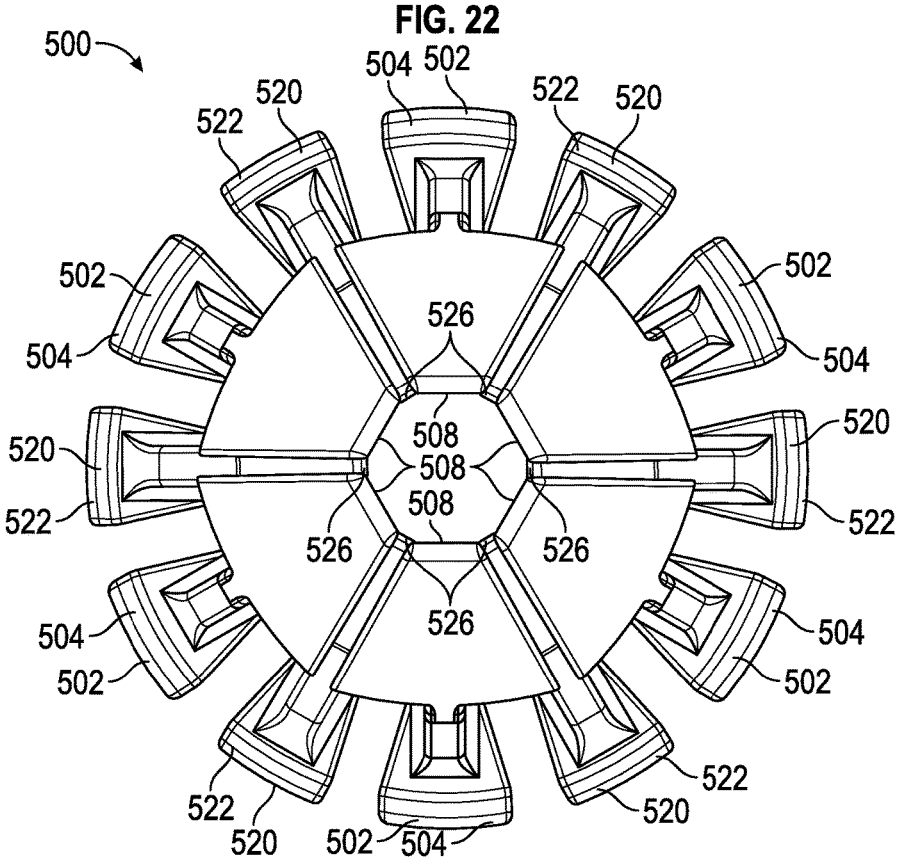
FIG. 23 is a top view of the inserts shown in FIG. 18 disposed in the second position.
Figure 24:
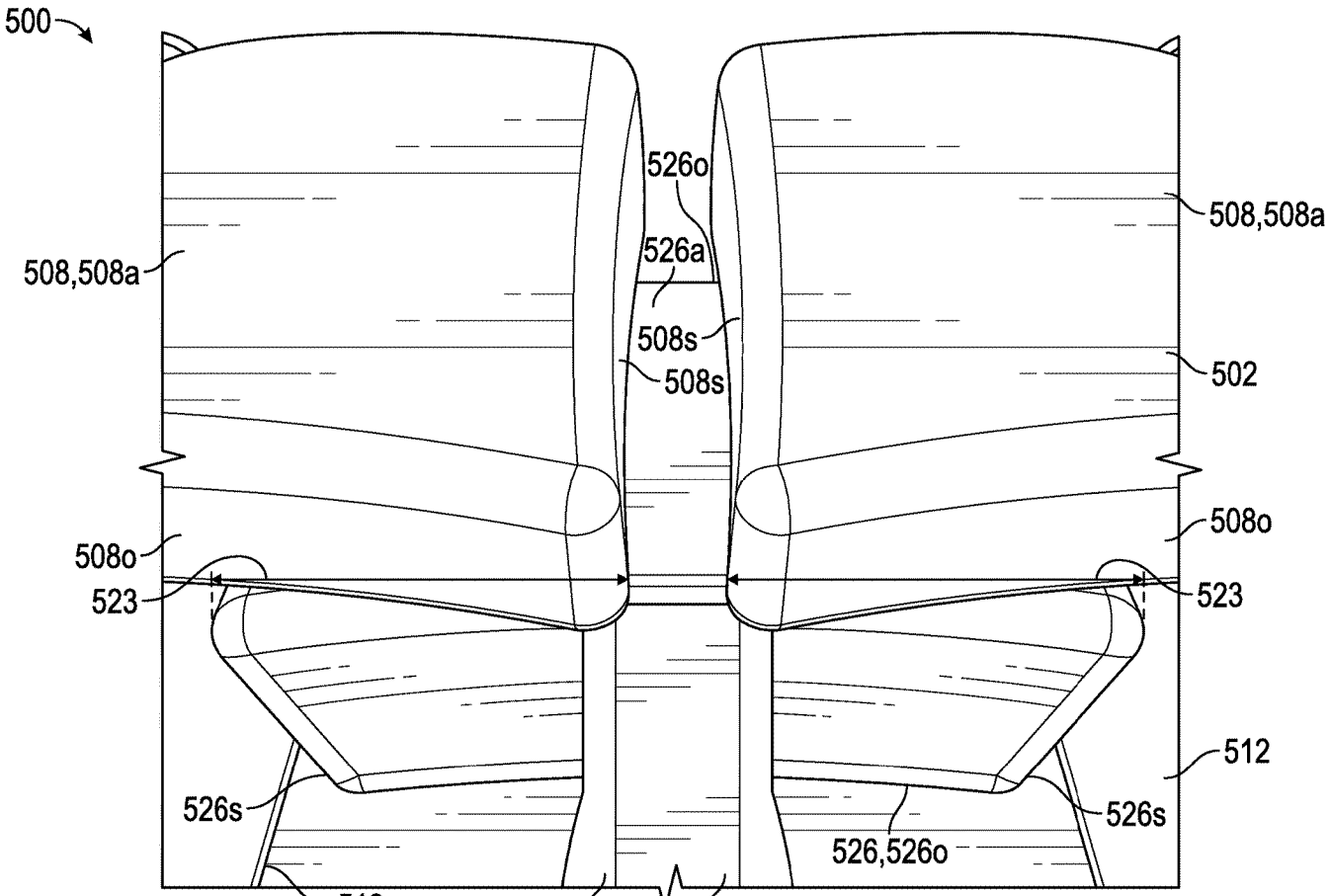
FIG. 24 is a zoomed-in side view of the inserts shown in FIG. 18 disposed in the second position.

Referring to FIGS. 22-24, when annular BOP 400 and elastomeric packer 500 are each disposed in the closed position a second arcuate overlap 523 (shown in FIG. 24) extends between the upper flange 526 (measured from the lateral sides 526*s* of upper flange 526) of each short insert 520 and the upper flange 508 (measured from the lateral sides 508*s* of upper flange 508) of each long insert 502 disposed directly adjacent the short insert 520. The second arcuate overlap 523, corresponding to the closed position of BOP 400 and packer 500, is greater in arcuate or circumferential length then the first arcuate overlap 517 shown in FIG. 19, which corresponds to the open position of BOP 400 and packer 500. Additionally, when BOP 400 and packer 500 are each disposed in the closed position, bore 556 is substantially reduced or eliminated (shown in FIG. 22), with inner surface 552 of elastomeric body 550 sealing against itself to restrict fluid communication through bore 556.

Referring to FIG. 16-24, annular BOP 400 and elastomeric packer 500 may be actuated between their respective open and closed positions in response to the selective pressurization of bore 404 of housing 402, similar to the actuation of BOP 100 described above. Particularly, in response to a selective pressurization of bore 404, piston 480 is displaced axially through bore 404, applying an axially upwards force 450 against the lower end of elastomeric packer 500. The application of force 450 against packer 500 causes long inserts 502 and short inserts 520 to rotate or pivot inwards in the direction of bore 556 in response to engagement from the hemispherical inner surface 444 of top 440, thereby sealing bore 556 via the sealing engagement of inner surface 552 (shown in FIG. 22).

Further, as packer 500 is actuated towards the closed position, the arcuate overlap between each adjacently disposed short insert 520 and long insert 502 increases. Particularly, the arcuate overlap is increased from the first arcuate overlap 517 shown in FIG. 19, corresponding to the open position of packer 500, to the second arcuate overlap 523 shown in FIG. 24, corresponding to the closed position of packer 500. Similar to the functionality provided by packer 300 described above, the presence of arcuate overlaps 517 and 523 restrict or prevent the flow of elastomeric material comprising elastomeric body 550 between each adjacently disposed short insert 520 and long insert 502. With the elastomeric material forming body 550 prevented from flowing between adjacently disposed inserts 520 and 508, the material forming body 550 is captured radially between the circumferentially positioned inserts 520, 502 and the inner surface 552 of body 550, thereby maintaining or enhancing the sealing pressure against inner surface 552 when packer 500 is disposed in the closed position. In turn, enhancement of the sealing pressure provided by packer 500 allows annular BOP 400 to be utilized in a wider range of environments (i.e., wider range of pressure and temperature environments) than a traditional BOP.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. An annular elastomeric packer for a blowout preventer, comprising:

a first insert comprising:

an upper flange extending between a radially inner end and a radially outer end;

a lower flange extending between a radially inner end and a radially outer end; and a rib extending between the upper flange and the lower flange, wherein the rib comprises a length extending between an upper end and a lower end of the rib;

a second insert comprising:

an upper flange extending between a radially inner end and a radially outer end;

a lower flange extending between a radially inner end and a radially outer end; and a rib extending between the upper flange and the lower flange, wherein the rib comprises a length extending between an upper end and a lower end of the rib and the lower flange extends radially inwards from the rib;

an elastomeric body coupled to the first insert and the second insert, and comprising an inner sealing surface;

wherein the length of the rib of the first insert is greater than the length of the rib of the second insert.

2. The elastomeric packer of claim 1, wherein:

the first insert comprises a length extending between an upper end of the upper flange and a lower end of the lower flange;

the second insert comprises a length extending between an upper end of the upper flange and a lower end of the lower flange; and the length of the first insert is greater than the length of the second insert.

3. The elastomeric packer of claim 1, wherein:

the upper flange of the first insert comprises a length extending between the radially inner end of the upper flange and the radially outer end of the upper flange;

the upper flange of the second insert comprises a length extending between the radially inner end of the upper flange and the radially outer end of the upper flange; and the length of the upper flange of the first insert is greater than the length of the upper flange of the second insert.

4. The elastomeric packer of claim 1, wherein:

the upper flange of the first insert comprises a pair of lateral ends extending between the radially inner end and the radially outer end of the upper flange;

the upper flange of the second insert comprises a pair of lateral ends extending between the radially inner end and the radially outer end of the upper flange; and an arcuate overlap extends between a lateral end of the upper flange of the first insert and a lateral end of the upper flange of the second insert.

5. The elastomeric packer of claim 4, wherein a lateral end of the lower flange of the first insert is circumferentially spaced from a lateral end of the lower flange of the second insert.

6. The elastomeric packer of claim 1, further comprising:

a plurality of the first inserts; and a plurality of the second inserts; wherein the plurality of the first inserts and the plurality of the second inserts are disposed along a common circumference.

7. An annular elastomeric packer for a blowout preventer, comprising:

a first insert comprising:

an upper flange extending between a radially inner end and a radially outer end, the upper flange comprising a width extending between a pair of lateral sides of the upper flange;

a lower flange extending between a radially inner end and a radially outer end; and a rib extending between the upper flange and the lower flange;

a second insert comprising:

an upper flange extending between a radially inner end and a radially outer end, the upper flange comprising a width extending between a pair of lateral sides of the upper flange;

a lower flange extending between a radially inner end and a radially outer end; and a rib extending between the upper flange and the lower flange, wherein the lower flange extends radially inwards from the rib;

an elastomeric body coupled to the first insert and the second insert, and comprising an inner sealing surface;

wherein the length of the rib of the first insert is greater than the length of the rib of the second insert.

8. The elastomeric packer of claim 7, further comprising a plurality of the first inserts, and a plurality of the second inserts.

9. The elastomeric packer of claim 8, wherein the plurality of the first inserts and the plurality of the second inserts are disposed along a common circumference.

10. The elastomeric packer of claim 7, wherein the upper flange of the first insert arcuately overlaps with the upper flange of the second insert.

11. The elastomeric packer of claim 10, wherein a lateral end of the lower flange of the first insert is arcuately spaced from a lateral end of the lower flange of the second insert.

12. The elastomeric packer of claim 7, wherein:

the rib of the first insert comprises a length extending between an upper end and a lower end of the rib;

the rib of the second insert comprises a length extending between an upper end and a lower end of the rib; and the length of the rib of the first insert is greater than the length of the rib of the second insert.

13. A blowout preventer, comprising:

a housing comprising a bore extending therein;

an annular piston slidably disposed in the bore of the housing; and an annular elastomeric packer disposed in the bore of the housing and in physical engagement with the piston, wherein the elastomeric packer comprises:

a plurality of circumferentially spaced first inserts and a plurality of second inserts, wherein each first insert comprises:

an upper flange extending between a radially inner end and a radially outer end;

a lower flange extending between a radially inner end and a radially outer end; and a rib extending between the upper flange and the lower flange, wherein the lower flange extends radially inwards from the rib and wherein the rib comprises a length extending between an upper end and a lower end of the rib;

an elastomeric body coupled to the plurality of inserts and comprising an inner sealing surface;

wherein each second insert comprises:

an upper flange extending between a radially inner end and a radially outer end;

a lower flange extending between a radially inner end and a radially outer end; and a rib extending between the upper flange and the lower flange, wherein the rib of each second insert comprises a length extending between an upper end and a lower end of the rib; and the length of the rib of the first insert is greater than the length of the rib of the second insert;

wherein the blowout preventer comprises a first position providing fluid communication through the bore of the housing, and a second position restricting fluid communication through the bore of the housing;

wherein, when the blowout preventer is disposed in the second position, there is an arcuate overlap between each adjacently disposed insert of the plurality of circumferentially spaced inserts.

14. The blowout preventer of claim 13, wherein the plurality of first inserts and the plurality of second inserts are disposed along a common circumference.

15. The blowout preventer of claim 13, wherein:

each first insert comprises a length extending between an upper end of the upper flange and a lower end of the lower flange;

each second insert comprises a length extending between an upper end of the upper flange and a lower end of the lower flange; and the length of the first insert is greater than the length of the second insert.

16. The blowout preventer of claim 13, wherein the upper flange of each first insert comprises a length extending between the radially inner end of the upper flange and the radially outer end of the upper flange;

the upper flange of each second insert comprises a length extending between the radially inner end of the upper flange and the radially outer end of the upper flange; and the length of the upper flange of each first insert is greater than the length of the upper flange of each second insert.

17. The blowout preventer of claim 16, wherein:

the upper flange of each first insert comprises a pair of lateral ends extending between the radially inner end and the radially outer end of the upper flange;

the upper flange of each second insert comprises a pair of lateral ends extending between the radially inner end and the radially outer end of the upper flange; and an arcuate overlap extends between a lateral end of the upper flange of each first insert and a lateral end of the upper flange of each second insert.

18. A blowout preventer comprising:

a housing comprising a bore extending therein;

an annular piston slidably disposed in the bore of the housing; and an annular elastomeric packer disposed in the bore of the housing and in physical engagement with the piston, wherein the elastomeric packer comprises:

a plurality of circumferentially spaced first inserts and a plurality of second inserts, wherein each first insert comprises:

an upper flange extending between a radially inner end and a radially outer end, the upper flange of each first insert comprising comprises a width extending between a pair of lateral sides of the upper flange;

a lower flange extending between a radially inner end and a radially outer end; and a rib extending between the upper flange and the lower flange, wherein the lower flange extends radially inwards from the rib;

each second insert comprises:

an upper flange extending between a radially inner end and a radially outer end, the upper flange of each second insert comprising comprises a width extending between a pair of lateral sides of the upper flange;

a lower flange extending between a radially inner end and a radially outer end;

and a rib extending between the upper flange and the lower flange;

a length of the rib of the first insert is greater than a length of the rib of the second insert an elastomeric body coupled to the plurality of inserts and comprising an inner sealing surface;

wherein the blowout preventer comprises a first position providing fluid communication through the bore of the housing, and a second position restricting fluid communication through the bore of the housing;

wherein, when the blowout preventer is disposed in the second position, there is an arcuate overlap between each adjacently disposed insert of the plurality of circumferentially spaced inserts.

* * * * *